US007326925B2

(12) United States Patent
Verentchikov et al.

(10) Patent No.: US 7,326,925 B2
(45) Date of Patent: Feb. 5, 2008

(54) MULTI-REFLECTING TIME-OF-FLIGHT MASS SPECTROMETER WITH ISOCHRONOUS CURVED ION INTERFACE

(75) Inventors: Anatoli N. Verentchikov, St. Petersburg (RU); Mikhail Yavor, St. Petersburg (RU)

(73) Assignee: Leco Corporation, St. Joseph, MI (US)

( * ) Notice: Subject to any disclaimer, the term of this patent is extended or adjusted under 35 U.S.C. 154(b) by 112 days.

(21) Appl. No.: 11/277,181

(22) Filed: Mar. 22, 2006

(65) Prior Publication Data

US 2006/0214100 A1 Sep. 28, 2006

Related U.S. Application Data

(60) Provisional application No. 60/664,062, filed on Mar. 22, 2005.

(51) Int. Cl.
*H01J 49/40* (2006.01)

(52) U.S. Cl. ..... 250/287; 250/294; 250/281; 250/287

(58) Field of Classification Search ..... 250/287
See application file for complete search history.

(56) References Cited

U.S. PATENT DOCUMENTS 4,072,862 A 2/1978 Mamyrin et al.
4,963,736 A 10/1990 Douglas et al.
5,654,544 A * 8/1997 Dresch ..... 250/287
5,847,385 A * 12/1998 Dresch ..... 250/287
6,888,130 B1 * 5/2005 Gonin ..... 250/287
2005/0242279 A1 11/2005 Verentchikov

FOREIGN PATENT DOCUMENTS

SU 198034 1/1966
SU 1725289 4/1992

(Continued)

OTHER PUBLICATIONS

A. Casares, et al., "Multipass time-of-flight mass spectrometers with high resolving powers," International Journal of Mass Spectromtery, 206, 2001, 267-273.

(Continued)

*Primary Examiner*—Nikita Wells
*Assistant Examiner*—James J Leybourne
(74) *Attorney, Agent, or Firm*—Price, Heneveld, Cooper, DeWitt & Litton, LLP

(57) ABSTRACT

The present invention relates generally to a multi-reflecting time-of-flight mass spectrometer (MR TOF MS). To improve mass resolving power of a planar MR TOF MS, a spatially isochronous and curved interface may be used for ion transfer in and out of the MR TOF analyzer. One embodiment comprises a planar grid-free MR TOF MS with periodic lenses in the field-free space, a linear ion trap for converting ion flow into pulses and a C-shaped isochronous interface made of electrostatic sectors. The interface allows transferring ions around the edges and fringing fields of the ion mirrors without introducing significant time spread. The interface may also provide energy filtering of ion packets. The non-correlated turn-around time of ion trap converter may be reduced by using a delayed ion extraction from the ion trap and excessive ion energy is filtered in the curved interface.

42 Claims, 11 Drawing Sheets

FOREIGN PATENT DOCUMENTS

WO WO 2005001878 1/2005

OTHER PUBLICATIONS

Boris N. Kozlov, et al., "Linear Ion Trap with Axial Ejection as a Source for a TOF MS," ASMS 2005 (www.asms.org).

V.I. Karataev, B.A. Mamyrin, and D.V. Shmikk, "New Method for Focusing Ion Bunches in TOF MS," Sov. J. Tech. Phys. 41 (1971) 1498, Soviet Physics—Technical Physics, vol. 16, No. 7, pp. 1177-1179, (Jan. 1972).

W.P. Poschenrieder, "Multiple-Focusing Time-of-Flight Mass Spectrometers Part II TOFMS with Equal Energy Acceleration," Int. Journal of Mass Spectrometry and Ion Physics, 9 (1972), pp. 357-373.

A.V. Tolmachev, et al., "A collisional focusing ion guide for coupling an atmospheric pressure ion source to a mass spectrometer," Nucl. Instr. Meth., B 124 (1997), pp. 112-119.

Michisato Toyoda, et al., "Multi-turn time-of-flight mass spectrometers with electrostatic sectors," J. Mass Spectrom. 2003; 38: pp. 1125-1142.

H. Wollnik, "Mass Separators," Nuclear Instruments and Methods in Physics Research, A 258, (1987) pp. 289-296.

H. Wollnik, "Optics of Charged Particles," Academic Press, Inc., Orlando, 1987.

* cited by examiner

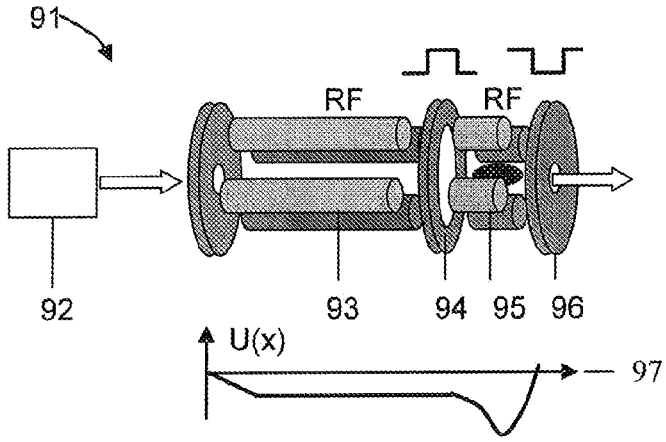
FIG. 9
FIG. 10A
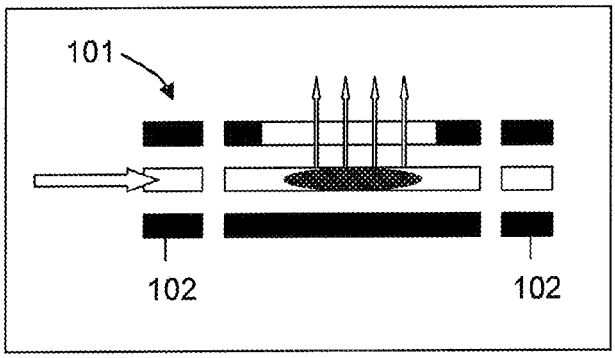
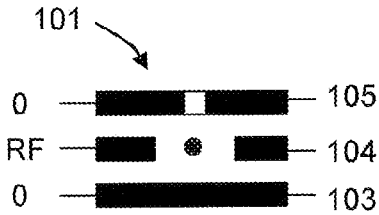
FIG. 10B
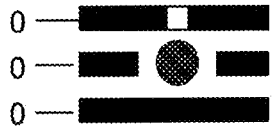
FIG. 10C
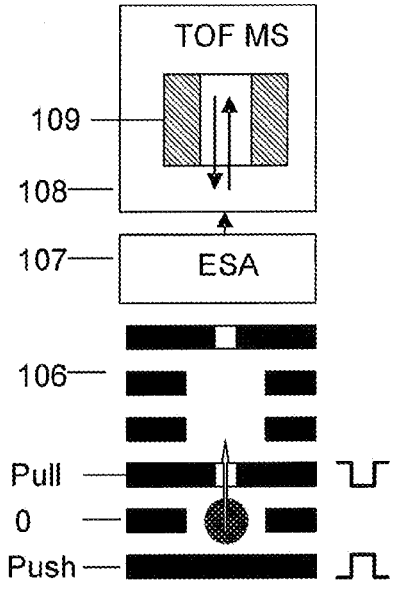
FIG. 10D

MULTI-REFLECTING TIME-OF-FLIGHT MASS SPECTROMETER WITH ISOCHRONOUS CURVED ION INTERFACE

CROSS-REFERENCE TO RELATED APPLICATION

This application claims priority under 35 U.S.C. §119(e) on U.S. Provisional Patent Application No. 60/664,062 filed on Mar. 22, 2005, entitled "MULTI-REFLECTING TIME-OF-FLIGHT MASS SPECTROMETER WITH AN ENERGY FILTER," and filed on behalf of Anatoli N. Verentchikov et. al., the entire disclosure of which is incorporated by reference herein.

BACKGROUND OF THE INVENTION

The present invention generally relates to the area of mass spectroscopic analysis, and more particularly relates to mass spectrometer apparatus, including a multi-reflecting time-of-flight mass spectrometer (MR TOF MS) and a method of use.

Time-of-flight mass spectrometers (TOF MS) are increasingly popular—both as stand-alone instruments and as a part of mass spectrometry tandems with another TOF (TOF-TOF), with a quadrupole filter (Q-TOF), or with an ion trap (ITMS-TOF). They provide a unique combination of high speed, sensitivity, mass resolving power (hereinafter called resolution) and mass accuracy. Even higher resolution and mass accuracy are desired for analysis of complex mixtures, typical for applications in biotechnology and pharmaceuticals.

The introduction of multi-reflecting and multi-turn schemes has recently led to substantial improvement of the resolution of time-of-flight mass spectrometers.

Before continuing, it will be useful to define some terms used throughout this document. As used herein, a "planar multi-reflecting time-of-flight mass analyzer" is a device that comprises two elongated ion mirrors, which are preferably grid-free. Ions are reflected between the ion mirrors while slowly drifting in the direction of elongation of the ion mirrors (the "drift direction").

"Aberrations" means expansion coefficients for spatial or time-of-flight deviations caused by spread in the initial ion parameters.

"First order focusing" corresponds to the compensation of the first derivative of an output parameter (at the output of the device) per linear variation of the input parameter. First order expansion coefficients are often referred to as "linear coefficient" or "first derivative." First order focusing may include "first order time-of-flight focusing with respect to ion energy," "first order time-of-flight focusing with respect to spatial coordinates," "first order spatial focusing," and "first order spatial per energy focusing," which are discussed below.

"First order time-of-flight focusing with respect to ion energy" corresponds to compensation of the time of flight T derivative per ion energy k, i.e., $dT/dk=T|k=0$. Devices that perform such compensation are referred to as "energy isochronous."

"First order time-of-flight focusing with respect to spatial coordinates," occurs in "spatially isochronous" devices and corresponds to: $dT/dx=T|x=0$, $dT/dy=T|y=0$, $dT/d\alpha=T|\alpha=0$ and $dT/d\beta=T|\beta=0$. A device may be spatially isochronous in one perpendicular direction, e.g., only $T|x=0$ and $T|\alpha=0$.

"Spatial coordinates" is usually meant to refer to both angles to the ion path $\alpha$ and $\beta$ and perpendicular coordinates x and y, which are measured in directions perpendicular to the ion path and in some cases within an isochronous plane.

"First order spatial focusing," also referred to as just "focusing," corresponds to compensation of the first order derivatives of output spatial coordinates and angles with respect to initial spatial coordinates and angles usually annotated as: $x|x=0$, $x|\alpha=0$, $\alpha|\alpha=0$, $\alpha|x=0$, etc.

"First order spatial per energy focusing," also denoted as "chromatic" focusing and corresponds to so-called "achromatic" devices, means the compensation of the first order derivatives of the output spatial coordinates (and angles) with respect to ion energy variations–$x|k=0$, $y|k=0$, $\alpha|k=0$, and $\beta|k=0$.

"Second order aberrations" are second derivatives, which are defined as analogous, but also means cross-term aberrations. A few examples of "second order aberrations" include "second and third order time-of-flight aberrations with respect to ion energy," "second order time-of-flight aberrations with respect to spatial coordinate(s)," "second order spatial aberrations," and "second order chromatic aberrations," which are discussed below.

"Second and third order time-of-flight aberrations with respect to ion energy" mean $d^2T/dk^2=T|kk$ and $d^3T/dk^3=T|kkk$, respectively. "Second order energy isochronous" means that both $T|k=0$ and $T|kk=0$.

"Second order time-of-flight aberrations with respect to spatial coordinate(s)," i.e. "second order spatially isochronous," may correspond to one plane, which means that all $T|x=T|\alpha=T|xx=T|\alpha\alpha=T|x\alpha=0$.

"Second order spatial aberrations" correspond to $x|xx$; $x|x\alpha$; $x|\alpha$, $\alpha$, etc.

"Second order chromatic aberrations" correspond to $x|\alpha k$, $\alpha|\alpha k$, $x|xk$, $\alpha|xk$, etc.

"Spatially isochronous device" means that, at the exit of the device, there exists a so-called "isochronous plane," i.e., a plane where the ion flight time measured from some "reference plane," which is located in front of the device, is linearly independent on both coordinates and angles of the ion trajectory. Within the description, the term "isochronous" means spatially isochronous.

"Achromatic device" is the standard term used in ion optics. It means that the device does not have linear coordinates and angular dispersion with respect to ion energy. In other words the ion coordinates and angles at the exit of the device do not depend on ion energy in the linear approximation. From general ion optics [H. Wollnik, Optics of Charged Particles, Acad. Press, Orlando, 1987], it is known that an achromatic device is an automatically spatially isochronous device with both reference plane and isochronous plane being perpendicular to the central ion path.

"Spatial focusing" means geometric focusing of an initially wide (parallel, converging or diverging) ion beam or bunch into a small-size "crossover."

"Pulsed converter" means a device which converts a continuous or quasi-continuous ion flow into ion packets. Examples include an orthogonal accelerator or ion traps with an axial or radial pulsed ion ejection.

"Energy filtering property" is an ability to transfer ions within a limited energy range, while rejecting all other ions. As described further below in the detailed description of the invention, since curved devices create an energy dispersion somewhere inside, they allow filtering an energy range by setting a stop (a slit or an aperture) in the appropriate plane usually coinciding with the plane of geometric focusing, i.e., "crossover" plane.

"Matsuda plates" are electrodes terminating electrostatic sector fields and aligned parallel to the plane of the curved ion path. The plates are used to adjust curvature of electrostatic equipotential lines in the direction orthogonal to the ion path plane, i.e., so called "toroidal factor."

A recent example of multi-turn instrument—MULTUM [Toyoda et. al., J. Mass Spectrom. V.38, #11 (2003), pp. 1125-1142] is built of four electrostatic sectors, arranging the ion trajectory in the shape of a figure-eight. The scheme provides for a first order time-of-flight focusing with respect to ion energy k, ion spatial coordinates x,y and corresponding angles $\alpha$ and $\beta$($T|k=T|x=T|\alpha=T|y=T|\beta 0$). A high resolving power—over 300,000 is demonstrated for ion packets of sub-millimeter size and at the energy spread below 1%. To reach high resolving power ions are passed over 500 closed cycles which reduces mass range proportionally.

Multi-reflecting instruments have been arranged between two coaxial and grid-free ion mirrors [H. Wollnik, Nucl. Instr. Meth., A258 (1987) 289]. A first-order time-of-flight focusing is achieved with respect to ion energy and spatial coordinates ($T|k=T|x=T|\alpha=T|y=T|\beta=0$). However, ultimate parameters of the scheme are limited by a pulsed ion injection. At least one mirror voltage is switched to pass ions in and out of the analyzer. Typical resolving power stays around 50,000 [A. Casares et. al., Int. J. of Mass Spectrom. 206 (2001) 267]. As in the previous case, multiple reflections automatically limit an acceptable mass range.

Most of the multi-reflecting and multi-turn instruments of the prior art do not provide for the full mass range, since ion trajectories are closed into loops. To solve the problem of mass range Nazarenko et. al. [Soviet Patent No. 1725289] in 1989 suggested a planar multi-reflecting time-of-flight (MR TOF) analyzer with a jig-saw ion path. Ions are reflected between two parallel and grid-free electrostatic mirrors while slowly drifting in the direction x of elongation of the ion mirrors—the "drift direction". The scheme avoids repetition in ion trajectories and this way ensures full mass range of the TOF MS. However, gradual expansion of ion packets causes spatial overlapping of ion trajectories at the adjacent reflections.

To avoid ion packet spatial divergence, the inventors further improved the MR TOF scheme as disclosed in commonly assigned PCT International Publication Number WO 2005/001878 A3, filed on Jun. 18, 2004 by Anatoli Verentchikov et al., by introducing periodic lenses between the ion mirrors of a planar MR TOF MS. The lenses ensure ion confinement along the central jig-saw ion trajectory by periodic refocusing after passing through these consecutive lenses ($x|\alpha=\alpha|x=0$).

To improve aberrations of the analyzer, the inventors also suggested using an optimized geometry of planar ion mirrors. It was found that four is the minimum sufficient number of mirror electrodes to provide simultaneously:

- A periodic spatial focusing of ion packets after two reflections ($y|\beta=\beta|y=0$);
- A second order time-of-flight focusing with respect to ion spatial coordinates and energy ($T|k=T|y=T|\beta=0$; $T|kk=T|yy=T|\beta\beta=T|ky=T|k\beta=T|y\beta=0$); and
- A third order time-of-flight focusing with respect to ion energy ($T|kkk=0$).

Simulations suggest that analyzer aberrations allow resolving power in excess of 100,000 at the energy spread of 7% and for ion packet dimensions of several millimeters. According to simulations, the resolving power becomes limited by two major remaining factors—aberrations appearing at the stage of ion injection into MR TOF MS and aberrations appearing in the pulsed ion source or in the pulsed converters positioned downstream of continuous ion sources. As used herein, "pulsed converters" means an orthogonal accelerator or pulse ejecting ion traps.

Let us consider the first factor limiting MR TOF MS resolution—aberrations occurring at ion injection into MR TOF MS. Earlier, in PCT International Publication Number WO 2005/001878 A3, the inventors suggested using an external ion source and injecting ions through the region of the mirror edges. Such injection inevitably introduces a number of time aberrations and spatial dispersion of ion packets as follows:

- First, ions are introduced at an angle and have to be steered within the MR TOF MS to follow the central ion trajectory. The steering causes tilting of time fronts.
- Second, the injected ion packets appear close to the mirror edges where the electrostatic field is distorted which may thus cause time aberrations. However, as described below with respect to FIGS. 1A-1C, this is not practical with existing sources and detectors.
- Third, the remote location of the ion source shifts the intermediate time focal planes from their optimal positions at the MR TOF axis and thus compromises the initial parameters of the ion packets and degrades the overall resolving power of the MR TOF MS.

Similar though less prominent problems appear when using internal ion sources or pulse converters. Realistic sizes of the accelerator and of the detector lead to an angled introduction of ions with subsequent ion steering. The ion packet steering remains the major source of time aberrations.

Let us consider the second factor limiting MR TOF MS resolution—time and energy spread appearing in the pulsed ion source. If assuming the source terms only, the resolution R limit could be expressed as a function of the energy tolerance ($\Delta k/k$) of TOF MS, the phase space of TOF MS ($L*V$), and the phase space of ion beam in the pulsed ion source ($\Delta x*\Delta V$) as follows:

$$R \leqq (\Delta k/k)*(L*V)/(\Delta x*\Delta V) \quad (1)$$

where L is an effective ion path, V is an average ion velocity and k is a mean ion energy in the TOF MS; $\Delta x$ and $\Delta V$ are spatial and velocity spreads of ions in the source prior to ion acceleration and $\Delta k$ is the ion energy spread after acceleration.

Multi-reflecting mass spectrometers provide an extended flight path L, which improves resolution and softens the effect on ion beam initial parameters. Still, the initial parameters of the ion packets in the source define time and energy spread of the ion packets, which is the second major limiting factor on MR TOF resolution.

The effect of the initial ion parameters becomes particularly dominating when using ion trap converters. Such traps are attractive since they are known to provide a complete (100%) conversion of continuous beam into sharp ion packets [B. Kozlov et. al. ASMS 2005, www.asms.org]. The trap converters are particularly attractive when using an MR TOF MS where injection pulses are sparse and thus the duty cycle of the alternative ion sources (like orthogonal acceleration (OA)) becomes very low. However, ions in traps are much hotter compared to OA and than ion packets characterized by significantly larger time spread.

In the past history of TOF MS, the resolution has been gradually improved while improving individual factors of the above equation (1). With the introduction of the ion mirror [U.S. Pat. No. 4,072,862, Soviet Patent No. 198034 and Sov. J. Tech. Phys. 41 (1971) 1498, Mamyrin et. al.], Mamyrin and coworkers improved energy tolerance $\Delta k/k$ of TOF mass spectrometers and reached second order time-of-flight focusing with respect to ion energy (Tlk=0 and Tlkk=0). Similarly, to compensate for ion energy spread in the first order (Tlk=0), Poschenrieder suggested a TOF MS built of electrostatic sectors [W. P. Poschenrieder, Int. J. Mass Spectrom and Ion Physics, v.9 (1972) p 357-373]. Introduction of collisional dampening of ions in gas-filled ion guides allowed improving the initial parameters of the ion beams, i.e., reducing initial spatial and velocity spreads $\Delta x$ and $\Delta V$ [U.S. Pat. No. 4,963,736]. Ion guides have been employed to improve ion beam characteristics in front of orthogonal accelerators [A. V. Tolmachev, I. V. Chernushevich, A. F. Dodonov, K. G. Standing, Nucl. Instrum. Meth., B124 (1997) 112.].

The phase space of the beam has also been reduced while skimming the beam, as in the case of orthogonal accelerators (OA). A continuous ion beam is expanded and then focused into an almost parallel beam. A portion of the beam is selected through a slit. As a result, typical parameters of a continuous ion beam passing the slit are 1 mm×1 deg, which is about 3 times better than the parameters of the ion beam directly past the damping quadrupole ion guide. Ion energy spread along the TOF axis becomes 3 times lower as compared to ion energy spread at room temperature.

Another strategy of reducing the phase space of the ion packets is described in the earlier cited paper of Poschenrieder. A so-called turn-around time of ion packets is reduced by raising the strength of extracting electrostatic field. This inevitably raises the energy spread of ion packets. The excessive energy spread is filtered within an electrostatic energy filter with a curved axis. The energy filter itself is suggested as a time-of-flight analyzer. A combination of sector field with a drift region allows for the first order time-of-flight focusing with respect to ion energy and with respect to ion spatial spread and divergence. However, as was stressed before, to reach high resolving power, the acceptance of the sector TOF analyzer should be substantially reduced—energy and spatial spread should be lower than in a planar MR TOF analyzer by an order of magnitude.

Summarizing the above, multi-reflecting planar time-of-flight analyzers are suited for high resolution and full mass range measurements. Ion trap sources are particularly attractive for MR TOF since they provide an effective pulsed conversion of ion beams in spite of sparse pulsing in the MR TOF. The resolution is primarily limited by ion injection around the edges of the ion mirrors. The second limiting factor is the phase space of the ion packets in the ion source, particularly when using ion trap converters. There is a need for a solution simultaneously improving the resolving power and the sensitivity of multi-reflecting TOF mass spectrometers.

SUMMARY OF THE INVENTION

According to one implementation of the present invention, a multi-reflecting time-of-flight mass spectrometer apparatus is provided that comprises: a pulsed ion source for generating ion packets; a planar multi-reflecting time-of-flight analyzer for separating ions of the ion packets by mass-to-charge ratio; an ion receiver for receiving the separated ions; and at least one spatially isochronous ion transfer interface, located in-between the ion source and the ion receiver, wherein the spatially isochronous ion transfer interface has a curved axis.

According to another implementation of the present invention, a time-of-flight mass spectrometer apparatus comprises: a gas-filled ion trap for generating ion packets, the ion trap including at least one electrode to which a radio frequency signal is applied, wherein the ion packets are extracted from said ion trap after a predetermined delay after switching of said radio frequency signal; an energy filter for transferring ions within a limited energy range; a time-of-flight mass analyzer for separating ions according to their mass-to-charge ratio; an ion receiver for receiving the separated ions; and a spatially isochronous energy filter positioned between said ion trap and said ion receiver for transferring ions within a limited energy range.

According to another implementation of the present invention, a hybrid time-of-flight mass analyzer apparatus comprises: at least one spatially isochronous set of electrostatic sectors; at least one ion mirror; and an ion receiver, wherein the ion mirror compensates for at least one second order time-of-flight aberration of the set of electrostatic sectors.

According to another implementation of the present invention, an apparatus comprises: an ion source for generating ions; a linear ion trap with a delayed ion extraction for ion accumulation and formation of ion packets; a planar multi-reflecting time-of-flight analyzer having a drift space with periodic lenses; an ion receiver; and at least one spatially isochronous C-shaped cylindrical interface located in between the linear ion trap and the ion receiver.

According to another implementation of the present invention, a multi-reflecting time-of-flight mass spectrometer apparatus comprises: a pulsed ion source for generating ion packets; a multi-reflecting time-of-flight analyzer for separating ions of the ion packets by mass-to-charge ratio, the multi-reflecting time-of-flight analyzer comprising at least one ion mirror; an ion receiver for receiving the separated ions; and at least one spatially isochronous ion transfer interface, located in-between said ion source and said ion receiver, wherein said at least one spatially isochronous ion transfer interface includes at least one electrostatic sector having a curved axis.

These and other features, advantages, and objects of the present invention will be further understood and appreciated by those skilled in the art by reference to the following specification, claims, and appended drawings.

BRIEF DESCRIPTION OF THE DRAWINGS

In the drawings:

FIG. 9 presents schematics of an ion pulse converter made of linear ion trap with axial ion ejection;

FIG. 10A presents a schematic side view of a rectilinear ion trap with radial ion ejection;

FIG. 10B shows the rectilinear trap of FIG. 10A at the stage of ion accumulation and cooling;

FIG. 10C shows the rectilinear trap of FIG. 10A at the stage of switching or ramping down of RF voltage;

FIG. 10D shows the rectilinear trap of FIG. 10A at the stage of ion ejection. It also presents the block diagram for illustrating the third aspect of the invention;

DETAILED DESCRIPTION OF THE PREFERRED EMBODIMENTS

As discussed above, multi-reflecting planar time-of-flight analyzers are designed for high resolution and full mass range measurements. They are particularly attractive in combination with ion trap pulsed converters. However, the resolution of planar MR TOF MS is primarily limited by ion injection around the edges of the ion mirrors. The second limiting factor is the phase space of the ion packets in the source, particularly in the case of using ion trap converters.

Figure 1A:
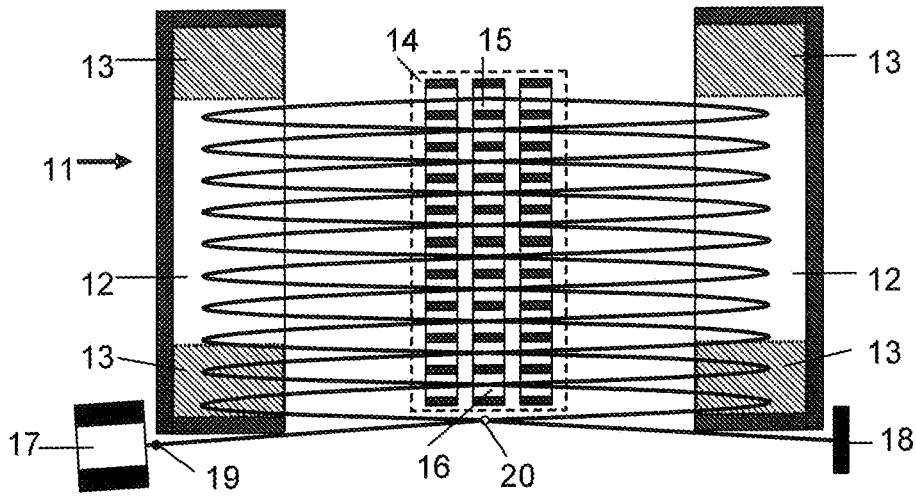
FIGS. 1A-1C illustrate schematics of ion injection into planar MR TOF MSs of prior art.

A prior art planar MR TOF MS is shown in FIG. 1A. The planar MR TOF analyzer 11 comprises two elongated planar grid-less ion mirrors 12 and a block of periodic lenses 14. Ions move between the mirrors along a jig-saw path being periodically reflected by mirrors 12. The angle of incidence of the ions to the mirrors ("drift angle") is typically about 1 degree. Lenses 14 refocus the ions and thus keep them confined along the central path tilted by 1 degree. Small drift angle allows substantial elongation of the flight path relative to the physical length of the analyzer—at 1 degree drift angle their ratio reaches 50. Details of the ion mirror and lens design are described in PCT International Publication Number WO 2005/001878 A3. After passing through the analyzer one way, the ions are sent back again into the analyzer by a deflector 15. Deflection by small angle (for example, 2 degrees) reverses the direction of ion drift, thus further doubling the ion flight path while retaining full mass range. If necessary a lens 16 can be switched to a deflecting mode to send the ions once again back into the analyzer. This allows raising the flight path and thus the resolution of the analyzer considerably at the expense of shrinking the accepted mass range ("zoom mode").

Referring to FIG. 1A, typical prior art planar MR TOF MS comprises an externally located pulsed ion source 17 and an external ion detector 18. Both, ion injection from the external ion source into MR TOF analyzer and ion ejection onto the external detector introduce a significant drawback—ions pass through the regions 13 of the edge or 'fringing' electrostatic fields of ion mirrors 12. These fringing fields appear near the edges of the ion mirrors and they have a 3D structure which is different from the 2D planar field inside the mirrors. Focusing and time-of-flight properties of 3D fields are different from those in 2D fields. Fringing fields perturb the ion motion and inevitably spread the ion bunches and thus notably deteriorate the mass resolving power of the analyzer.

The external position of the ion source also means another disadvantage—ions have to pass a long drift space from the source to the analyzer. In this case the position 19 of the primary time focus after ion source 17 occurs far away from its optimal position 20 (in the middle between ion mirrors 12). To compensate for a long drift space, the tuning of the MR TOF analyzer changes, which deteriorates the analyzer preformance and complicates tuning in the mass zoom mode.

Figure 1B:
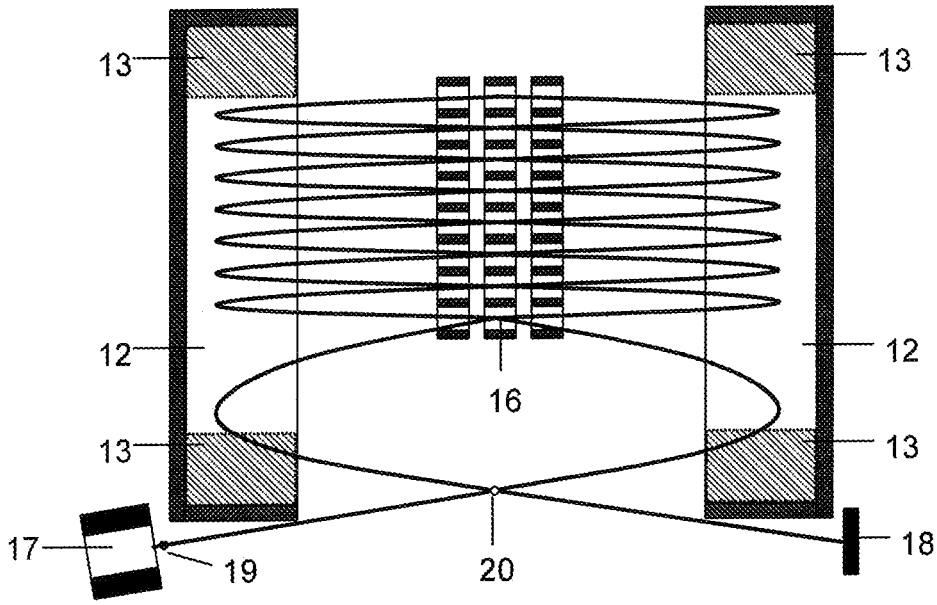

Referring to FIG. 1B, the problem of fringing fields can be partially solved by increasing the ion entrance angle to about 10 degrees. Ions are injected far away from the mirror edges. In this case, however, the ions have to be steered back to the drift angle within the analyzer, for example, by the deflector 16. Ion deflection leads to a tilt of the time front across the ion bunch and thus leads to considerable decrease of the analyzer resolution. For a 1 mm wide beam and 10 degree steering, the tilt of the front reaches 0.15 mm. For a 30 m flight path in the MR TOF MS, the steering alone would limit resolving power to 10,000. Also, injection at such a large angle does not solve the problem of the remote location of the primary time focus 19 far away from the desirable position 20.

Figure 1C:
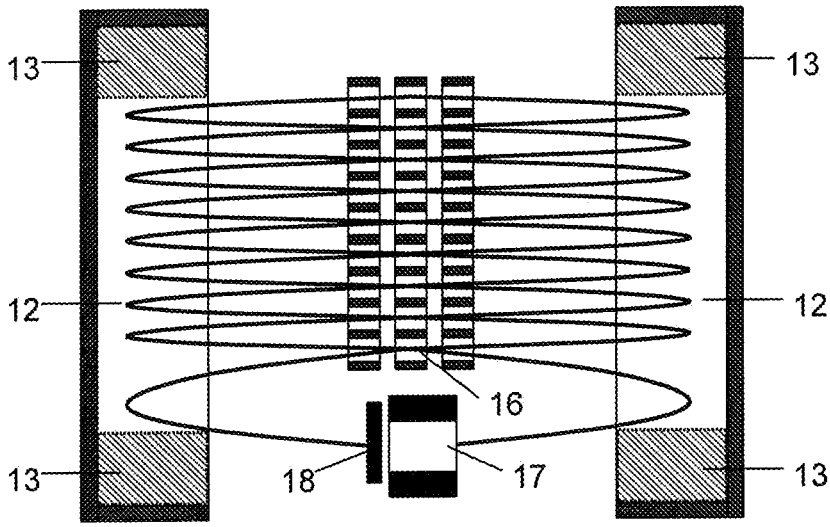

Referring to FIG. 1C, in an alternative injection scheme, a pulsed ion source 17 and a detector 18 can be inserted into the field-free space between ion mirrors 12. This solves the problem of edge fields and the primary time focus position can be located close to its desired position. However, any reasonable physical dimensions of the ion detector and especially of the ion source again would require an angled ion injection followed by ion steering. The typical steering angle can be reduced to about 2-3 degrees depending on analyzer and ion source sizes. Still, such ion steering limits the resolving power at the level of 50,000.

The steering can be avoided if using a substantially larger drift angle. However, it means a much smaller savings in the flight path relative to physical length of the analyzer. Also, if an edge deflection (in deflector 15) is employed, the same aberrations would be picked up at the stage of deflection. A gain in flight path usually outweighs the effect of injection aberrations, so the injection at a large angle is not considered as an optimal solution.

In summary, ion injection into the prior art planar MR TOF MS causes multiple time-of-flight aberrations, either related to passing through fringing (edge) fields of the two-dimensional ion mirrors or related to ion deflection which are necessary to direct the ions along the central trajectory.

The inventors have realized that resolution of the planar MR TOF MS could be improved if using isochronous ion interfaces with a curved ion axis, further called "curved interfaces." The invention suggests a number of deflecting systems which are isochronous and are well suited for ion transfer in and out of an MR TOF MS. Such systems can improve resolution of the MR TOF MS by reducing the effect of the two major limiting factors—injection aberrations and ion source terms. The injection aberrations are reduced since ions are passed around the edges and around fringing fields of the ion mirrors. The ion source terms can be reduced by energy filtering within the interface. Preferably, the apparatus of the present invention is configured such that the ion packets are injected in between ion mirrors at sufficient distance from mirror edges to avoid the effect of fringing fields. The minimum distance depends upon injection angle, beam width and required resolution. The ratio of the distance to the size of the mirror window is at least about 0.5 to 1, preferably from 1 to 1.5, and even more preferably from 1.5 to 2. Preferably, the injection angles are less than 5 degrees, 3 degrees, or more preferably less than 1 degree. As described below, an interface may be provided to inject the ion packets at the desired location and angle.

A combined system of a curved interface and a planar MR TOF MS appears synergistically advantageous compared to either one individual system alone. If the curved interface would be used alone as a TOF MS analyzer it would either limit resolution or acceptance of the analyzer. A combined system provides a higher order time-of-flight focusing. Even if using large spatial acceptance of the curved interface, its effect is shown to be mild—lower than aberrations of conventional ion introduction into the planar MR TOF analyzer.

According to the first aspect of the invention, an isochronous interface with a curved ion axis is employed in combination with a planar MR TOF analyzer in order to transfer ions around the edge of the ion mirrors on the way in and out of the analyzer.

In a preferred embodiment, the interface is incorporated into the MR TOF analyzer structure in order to pass ions around the edge and fringing fields of the ion mirrors. Note that the interface can be oriented in various planes in order to pass either around the long sides or around the short side of the ion mirrors.

Optionally, the interface is pulsed-operated. For example, ions are injected at one steady voltage setting of the interface and then at least one voltage of the interface is switched off for ion separation in the MR-TOF analyzer.

The inventors have found a number of curved interfaces which are well compatible with MR-TOF MS analyzers because they are time and spatial focusing devices. In order not to degrade the resolving power of planar MR TOF analyzers, the curved interface should be at least spatially isochronous. In other words, the spatial and angular spread of the ion packets should not introduce time spread at least in a linear approximation.

Another energy isochronous feature (time-of-flight focusing with respect to ion energy) is desirable but not necessary in curved interfaces, since linear and second order time per energy aberrations could be compensated in the MR TOF analyzer itself. Further, as used herein, the term "isochronous interface" primarily means "spatially isochronous interface."

Curved ion interfaces may be built of deflectors and electrostatic sectors. Sector fields could be of various symmetries (cylindrical, spherical, toroidal) and could be complimented by Matsuda plates (adjusting toroidal factor) as well as by free spaces, slits and lenses. A perspective view of cylindrical sectors is shown in FIG. 12B.

There are multiple examples in prior art of spatially isochronous electrostatic sector systems, like 254 degree cylindrical sectors (270 degrees accounting fringing field effects) or a combination of sector fields in the earlier cited MULTUM device. However, to the inventors' knowledge, those systems have not been used in conjunction with ion mirrors for time-of-flight mass spectrometry and particularly with planar MR TOF analyzers. Besides, a majority of the prior sector systems appear inconvenient for ion injection around edges of ion mirrors and most of them do not have convenient access for installing energy filtering slits. This application contains multiple examples of selected and newly designed isochronous interfaces with curved axes. A C-shaped system composed of three cylindrical sectors is designed and chosen as a preferred embodiment of the curved interface. The application also presents examples of two- and four-deflector injecting systems, as well as examples of alpha- and omega-shaped sector systems. Various sector systems are suggested to achieve isochronous deflection at different deflection angles: alpha- and omega-shaped systems retain the initial ion direction; a two sector system with the middle lens deflects the beam substantially orthogonal to the initial direction; and a C-shaped interface reverses the initial ion direction.

Curved interfaces are primarily suggested for ion injection from an ion source and into the MR TOF analyzer. In general, any fragmentation cell or the output of another mass spectrometer may be considered as a pulsed ion source for the MR TOF MS. Similarly, curved interfaces could be employed for ion ejection from the MR TOF analyzer and onto an external ion detector or any other external device such as a fragmentation cell or another stage of mass spectrometry. A combination of input and output interfaces can be employed.

The invention is compatible with multiple intrinsically pulsed ion sources, like MALDI, MALDI with delayed extraction, pulsed electron impact ionization, SIMS, etc. The invention is also suitable for multiple pulse converters like orthogonal accelerators (OA) and various ion traps—with radial and axial ion ejection. Cylindrical sectors are suited to pass elongated ion packets in case of prolonged converters like OA and linear ion traps (LIT).

The invention is particularly well suited for an MR TOF MS with ion trap converters. Ion traps keep accumulating ions in-between sparse TOF pulses, thus improving sensitivity. However, poor initial ion parameters, spatial and velocity spread in ion traps, may limit resolving power of the MR TOF MS.

According to the second aspect of the invention, an isochronous interface with a curved ion axis is suggested for energy filtering either in front or after a planar multi-reflecting TOF mass spectrometer. Deliberately introduced energy filtering within the interface is to improve characteristics of ion packets, particularly for ion sources with compromised time and energy spread. Energy filtering capability is considered while describing details of individual curved interfaces.

Preferably, interfaces are split into multiple deflecting elements, primarily to arrange a convenient location for the energy filtering slit or to achieve a convenient deflection angle within a compact package. The preferred location of the slit is in the plane, which is characterized by ion spatial crossover and sufficient energy dispersion. The slit may be fixed or adjustable. External or incorporated spatially focusing lens can be used to adjust the plane of spatial crossover in order to improve energy filtering.

In one embodiment, the curved interface may be arranged externally, just to add an energy filtering feature. Preferably, the interface is imbedded into the MR TOF analyzer structure in order to pass around the mirror edges.

In one group of ion sources, the naturally occurring energy spread may become excessive at unfavorable conditions and should be filtered to allow high resolution measurements. Energy filtering should improve pulsed ion sources like pulsed electron impact, MALDI and delayed extraction MALDI, SIMS, LIMS, etc.

In another group of ion sources, the natural energy spread is moderate. However, a higher strength of accelerating field is preferably applied to decrease a so-called turn around time. A related increase in energy spread is no longer a concern because of energy filtering in the interface. Such improvement is desirable for ion pulsed converters like an orthogonal accelerator (OA) and ion traps with axial and radial pulsed ion extraction.

The advantage of the energy filtering becomes particularly apparent when using ion trap sources. Ion trap sources are not presently accepted as pulsed converters for TOF MSs, primarily because of the large phase space of the ion packets. Ions from an ion trap are much hotter than those from an orthogonal accelerator. The energy filtering in the isochronous interface of the invention allows improvement to the parameters of the ion packets ejected from ion traps, which makes trap converters even more attractive for an MR TOF. The straightforward method is to raise the strength of the extracting field in order to reduce the turn around time.

According to the third aspect of the invention, a delayed extraction out of an ion trap is combined with energy filtering in the spatially isochronous interface with a curved ion path and with subsequent mass analysis in any TOF analyzer to improve the ion packet parameters after the ion trap. Preferably, the TOF analyzer is optimized in order to compensate for time-of-flight aberrations in the energy filter.

A preferred embodiment comprises a rectilinear ion trap, a cylindrical electrostatic sector and a planar MR TOF analyzer having a set of periodic lenses in the drift space. Preferably, the trap is oriented across the plane of the jig-saw ion trajectory in the MR TOF. An extracting pulse is applied after some predetermined delay (in microsecond time scale) after switching off an RF signal on the trap. Ion expansion during the delay makes correlated the initial ion parameters—ion position and velocity in the TOF direction. A non correlated velocity spread is decreased but the energy spread of the extracted ion packet gets larger. An excessive energy spread is removed after energy filtering and high resolving mass measurements become possible in the MR TOF MS. In one particular embodiment, the RF signal and pulses are applied to different electrodes of the trap.

Energy filtering also allows shorter accumulation times (when ion dampening is not complete) and using larger gas pressure in ion trap converters (which causes ion scattering at pulsed extraction and a 'halo' of lower energy ions). Both measures allow improving the repetition rate and the dynamic range of the instrument. Energy filtering also makes the instrument less dependent on ion source variations, i. e., provides decoupling between the ion source and the analyzer properties.

According to the fourth aspect of the invention, a time-of-flight mass analyzer comprises at least one spatially isochronous electrostatic sector and at least one ion mirror, such that the ion mirror compensates for at least up to second order time-of-flight aberration with respect to ion energy. Preferably, at least one mirror is gridless and is adjustable to compensate for at least one second order sector's aberration related to spatial spread of ion packets. Such a combination forms a novel class of time-of-flight analyzers, which are characterized by high performance and flexibility of the design.

It is of significance that electrostatic sector devices themselves are, as a rule, energy and spatially isochronous devices only in a linear approximation. Second order aberrations set the limit on the acceptance of sector devices when high resolution is required. However, once sectors are combined with grid-free ion mirrors, the hybrid system may be designed free of the second order time-of-flight aberrations with respect to spatial spread and ion energy. The mirrors can compensate for the second order and at least partially even for the third order time-of-flight aberrations in the sectors. In other words, the overall performance, including time-of-flight resolution, energy acceptance and spatial acceptance of the hybrid TOF can be comparable to those in a planar MR TOF MS. At the same time curved sectors provide flexibility in the system design as well as earlier stressed advantages of easier ion introduction and the ability of energy filtering.

It is also significant that the combination of electrostatic sectors and grid-free ion mirrors is capable of reaching high order spatial focusing and also achieving stigmatic imaging. Such features are important for imaging time-of-flight mass spectrometry and also are useful for the design of tandem mass spectrometers where ions are transferred through small apertures.

In a preferred embodiment, at least one C-shaped and cylindrical interface is employed to transfer ions between planar and grid-free ion mirrors. However, the novel class of hybrid analyzers is not limited by the particular type of electrostatic sector or by the planar type of ion mirrors.

This preferred embodiment is demonstrated on the example of few particular embodiments. In one particular embodiment, a spatially isochronous sector interface is employed to transfer ions between at least two parallel MR TOF analyzers, aligned into a multi-level assembly. Isochronous sectors are used to pass ions between the floors. In another particular embodiment, an isochronous cylindrical sector with total 180 degree deflection is suggested to pass ions between two parallel ion mirrors—one mirror sitting on the top of another. The arrangement opens ion access in and out of the planar ion mirror.

Both particular embodiments maximize the ion path per vacuum chamber size. Multiple parallel mirrors could be conveniently and inexpensively made by machining multiple windows within the same electrodes. The sector is preferably made cylindrical, while ion confinement in the drift direction is achieved in the periodic lenses.

Multiple systems could be synthesized using isochronous sectors and ion mirrors. Sectors may be used to reverse the direction of ion drift motion in a planar MR TOF MS. Sectors could be used to transfer ions between different analyzers (pulsed and static operated). Spatial focusing and isochronous hybrid systems could be employed for tandem mass spectrometric analysis. Tight ion focusing appears useful for ion transfer between small size apertures of ion sources, fragmentation cells, and second stage mass analyzers. Both cylindrical and planar symmetry of the ion mirrors are usable.

In addition the invention discloses multiple ways of using curved and isochronous interfaces within tandem instruments which employ at least one planar MR TOF analyzer.

In one particular embodiment, a curved interface is located in-between a planar MR TOF analyzer and a subsequent CID cell. The curved interface is used for convenient ion sampling out of an MR TOF analyzer and for adjusting ion energy at the cell entrance for regulating the degree of fragmentation. The invention is applicable for tandem TOF-TOF with a so-called parallel analysis of all parent ions, such as the tandem TOF-TOF described in commonly-assigned U.S. Patent Application Publication No. 2005/0242279 A1, filed on Jan. 11, 2005 by Anatoli Verentchikov, the entire disclosure of which is incorporated herein by reference.

In another particular embodiment, the ion trap source also works as a fragmentation cell. The same MR TOF analyzer is employed for both parent ion selection and mass analysis of fragment ions, as described in commonly assigned PCT International Publication Number WO 2005/001878 A3, filed on Jun. 18, 2004 by Anatoli Verentchikov et al., the entire disclosure of which is incorporated herein by reference. The curved interface between the trap and MR TOF analyzer carries multiple functions. It improves the characteristics of the ion packets, allows convenient passage of ions in and out of the MR TOF analyzer and also adjusts the ion energy at the fragmentation step.

All aspects of the invention are applicable to other tandem mass spectrometers like TOF-TOF, IT MS-TOF, and Q-TOF. The invention is also usable in combination with various separation methods at the front end, like chromatography and electrophoresis—LC-TOF, CE-TOF, and multi-stage separations, off-line and on-line.

Figure 2:
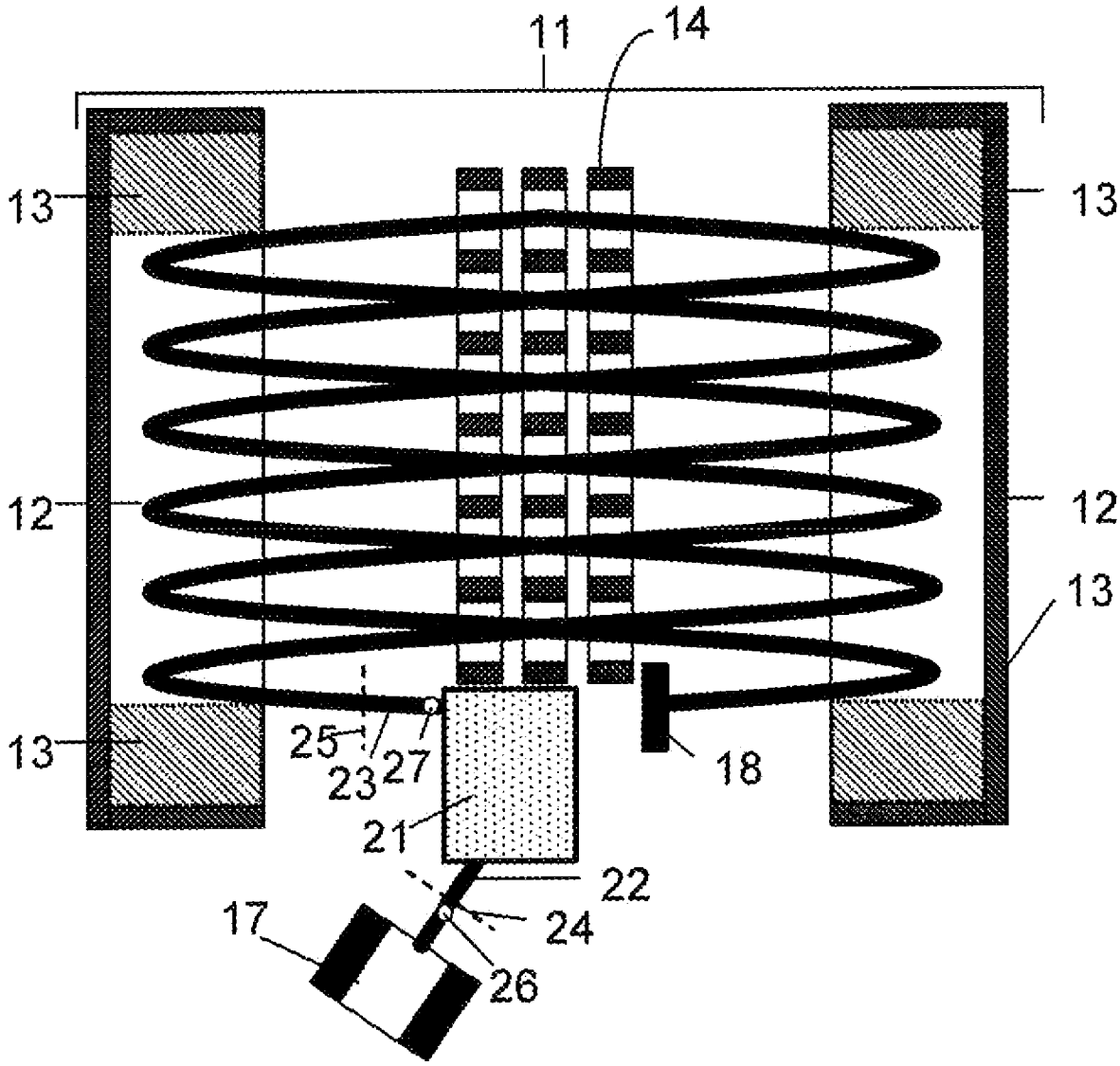
FIG. 2 shows a schematic diagram of ion injection into a planar MR TOF analyzer with the aid of the curved ion interface. The figure presents a generic view of the first aspect of the invention.

Referring to FIG. 2, in order to improve performance of an MR TOF MS, the inventors propose to use an isochronous ion transfer interface with a curved ion path for passing ions around the edges of ion mirrors 12. According to the first aspect of the present invention, the preferred embodiment comprises the following interconnected elements: a pulsed ion source 17, an isochronous ion transfer interface with a curved ion path 21, and a planar MR TOF analyzer 11 with periodic lenses 14. The interface 21 transfers ions leaving source 17 along a path 22 and injects them into the space between ion mirrors 12 of MR TOF analyzer 11 along a path 23 under the drift angle. The interface helps ions to pass around the edge region 13 of the edge electrostatic fields of ion mirrors 12. In order not to deteriorate the resolution of the analyzer, the interface is designed to be at least spatially isochronous.

The term "spatially isochronous" will now be described with respect to FIG. 2. Let us consider ions starting from pulsed ion source 17 with same energy and crossing some "reference plane" 24 while having some transverse spatial and angular spread. For ion trap converters, such reference plane is perpendicular to the central ion path. For OA converters, the reference plane is parallel to the direction of a continuous ion beam and thus tilted with respect to the central ion path. The interface is called spatially isochronous if the flight time (for certain ion energy) from the reference plane 24 to some "isochronous plane" 25 does not depend on initial transverse coordinates and angles at the reference plane at least in linear approximation.

To suit the requirements of an MR TOF, the isochronous plane 25 should be located between ion mirrors 12 and preferably be parallel to these mirrors. This means that such isochronous plane should be tilted under the drift angle of MR TOF analyzer with respect to the direction of the central ion path 23. In other words, the interface is not necessarily "achromatic."

Preferably, though not necessarily, the interface is energy isochronous. This means that the primary time focus 26 in front of interface 21 is refocused into a point 27 behind the interface. Preferably, the exit time focus is located near its optimal position in the middle of ion mirrors 12. Exact alignment of focus is not necessary since adjustment could be made by tuning ion mirrors of the MR TOF analyzer. Similarly, ion mirror adjustment can compensate for the second order time per energy aberrations of the interface and for the second order spatial aberrations in the plane perpendicular to the drawing plane.

Note that the interface can be oriented in various planes in order to pass either around the long sides or around the short sides of the ion mirrors. In the latter case, the trajectory displacement is minimal, but the physical width of the interface itself may become a concern. Optionally, the interface is pulsed operated. For example, ions are injected at one steady voltage setting of the interface and then at least one voltage of the interface is switched off for ion separation in the MR-TOF analyzer.

Figure 3A:
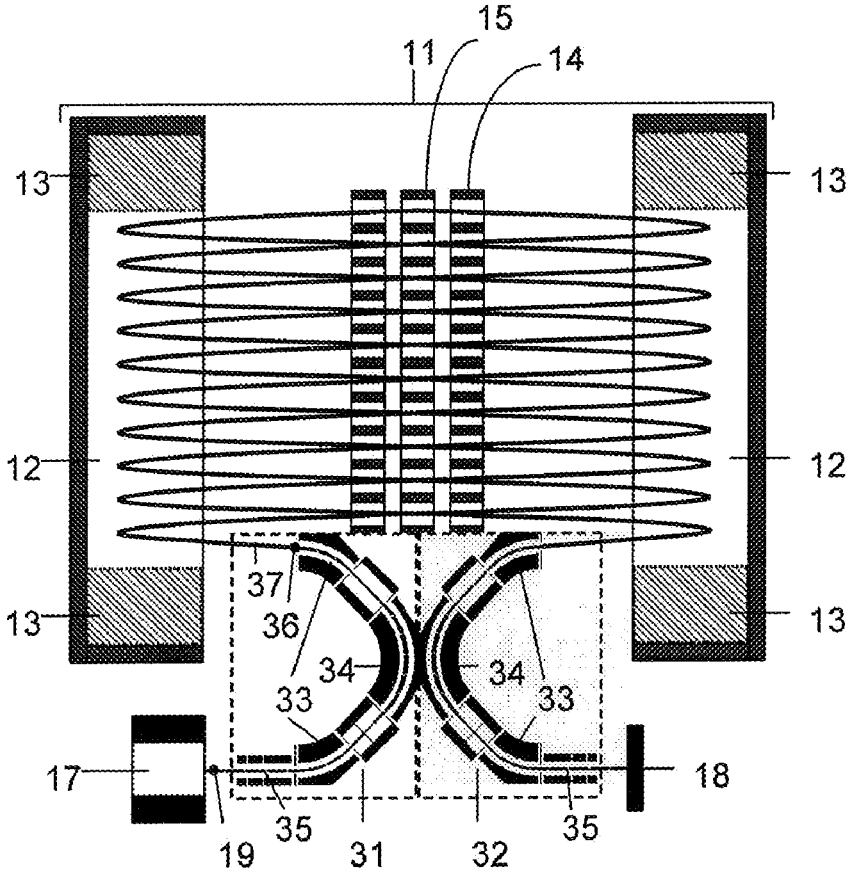
FIG. 3A shows one particular embodiment of an isochronous C-shaped interface of the invention suggested for ion injection in and out of a planar MR TOF analyzer.

Referring to FIG. 3A, according to the first aspect of the present invention, a preferred embodiment of the MR TOF MS with isochronous interface comprises an MR TOF analyzer 11 with periodic ion lenses 14, an externally located pulsed ion source 17, an ion detector 18, and two identical curved isochronous ion interfaces 31 and 32. Each interface comprises three cylindrical electrostatic sector analyzers—two 45-degree analyzers (33) and one 90-degree analyzer (34), separated by drift spaces. A detailed description of the ion optics of the interface and its design is given below. The interface allows a first order time-of-flight focusing with respect to ion spatial spread, divergence, and energy spread. Geometric ion focusing of the interface is tuned by a 2D electrostatic lens 35. The interface 31 allows the injection of ions into the analyzer along the central (mean) path 37 under a small drift angle (about 1 degree) such that the spatially isochronous plane of the interface is parallel to the ion mirrors. Energy isochronous interface 31 forms a time focus 36 outside and in close vicinity of the interface.

In operation, a pulsed ion source 17 generates ion packets with a time focus at point 19. The packets are directed orthogonal to the symmetry plane of the ion mirrors in planar MR TOF 11. Interface 31 transfers ions spatially isochronous. The isochronous plane is adjusted to be parallel to the symmetry plane of the MR TOF by means which are described below. Preferably, the exit time focus point 36 with respect to ion energy lies somewhere near the symmetry plane for optimal tuning of the MR TOF. Ions are transferred around the edge and fringing field 13 of ion mirror 12 and get injected into the analyzer 11. Because of the employed deflecting plane, the cylindrical interface has small transverse dimensions. For example, a 1 cm distance between interface 31 and first lens axis is reasonable, which allows ion passage without ion deflections at the entrance lens. As in the prior art, ions pass along a jig-saw ion trajectory aligned through centers of periodic lenses 14. The drift direction is reversed (here from up to down) by small angle steering in the last (upper) lens 15 and ions are directed through the analyzer and towards the exit isochronous interface 32 and then onto detector 18. As a result, curved interfaces 31 and 32 allow the ions to pass by the mirror edges without introducing significant time aberrations. As mentioned earlier, most of the second order aberrations occurring in the sector field could be compensated by ion mirror adjustments.

Figure 3B:
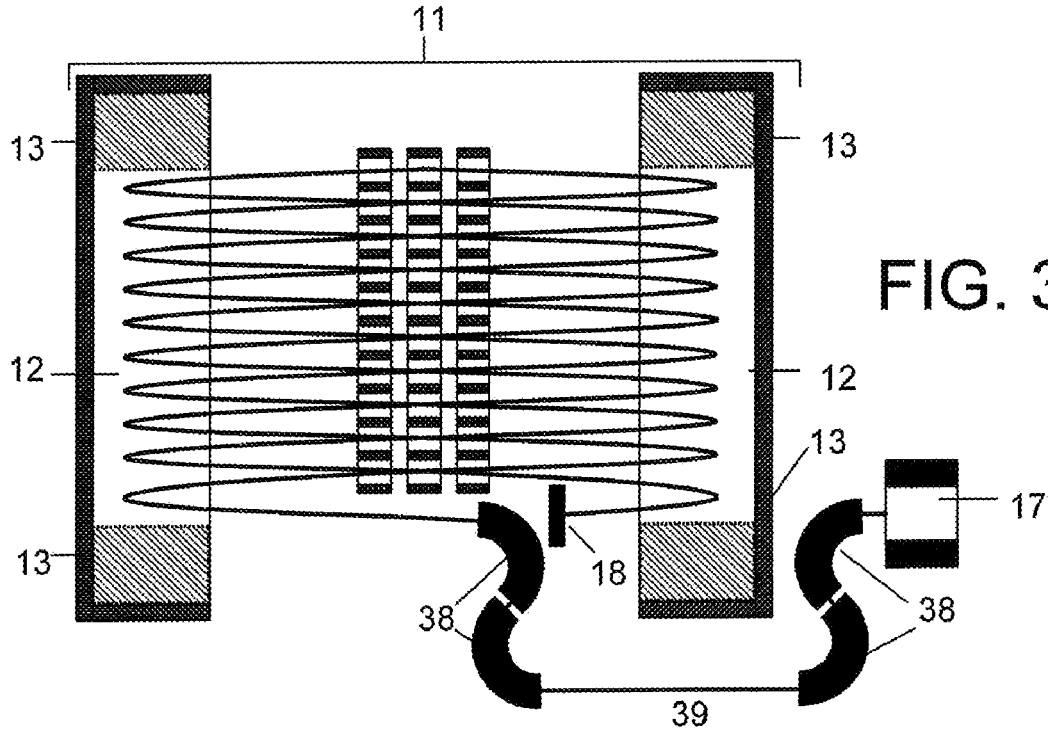
FIG. 3B shows another particular embodiment of an isochronous omega-shaped interface of the invention suggested for ion injection into a planar MR TOF analyzer.

FIG. 3B shows another embodiment of an isochronous interface comprising four identical electrostatic sector fields 38 arranged in an omega-shaped manner. Electrostatic sectors 38 (also called deflectors) can be cylindrical or toroidal. The drift distance 39 between the symmetrically arranged pairs of sectors can vary in a wide range for convenience of ion injection into the MR TOF analyzer. A more detailed description of the omega-shaped configuration is given below. FIG. 3B demonstrates the case where the pulsed ion source is located outside of the analyzer space and the ion detector is placed between the ion mirrors. Similar to the previous embodiment, the design of FIG. 3B avoids ion passage through fringing fields 13 of ion mirrors 12 and reduces the overall time spread of the MR TOF MS.

The described interfaces with curved ion paths are capable of energy filtering. The energy filtering capability of isochronous curved interfaces is considered as a separate—second aspect of the invention. Deliberately introduced energy filtering within the interface improves the characteristics of the ion packets, particularly for ion sources with compromised time and energy spread. Let us consider the energy filtering capabilities of individual curved interfaces while examining their ion optics properties.

Figure 4A:
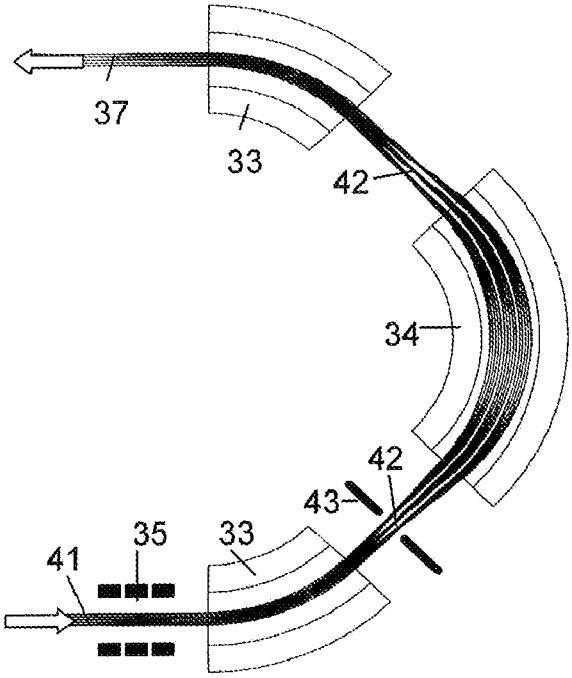
FIG. 4A shows ion optics scheme and ion trajectories for the C-shaped sector interface and is also used for explaining the energy filtering property of a curved interface—the second aspect of the invention.

Referring to FIG. 4A, let us consider ion optic properties of the 180-degree deflecting interface (so called C-shaped interface) in more detail. The interface comprises two 45-degree cylindrical sectors 33, symmetrically arranged on both sides of the 90-degree cylindrical sector 34. The first 45-degree sector creates spatial (i.e., coordinate and angular) energy dispersion, which is illustrated in FIG. 4A by trajectories of three ion beams with different energies. The length of the drift space between sectors is optimized such that ion beams of different energies become parallel in the middle of the 90-degree deflector, i.e., the angular energy dispersion vanishes there. For example, at 50 mm radius of ion deflection in all sectors, the considered drift distance is about 36 mm. Due to the symmetry of the device and in the case of parallel beams in the middle of the interface (zero angular dispersion), the ion trajectories become symmetric, i.e., the exiting ion trajectories become independent on ion energy. This also means that the system is spatially achromatic, i.e., it does not introduce any coordinate or angular linear energy dispersion. From general ion optics it is known [H. Wollnik, Optics of Charged Particles, Acad. Press, Orlando, 1987] that in spatially achromatic systems the flight time between a pair of planes perpendicular to the ion central path—one "reference" in front of the device and another "isochronous" at the exit from the system is independent in linear approximation on initial ion coordinates and angles. This is the definition of a spatially isochronous device with the isochronous plane being perpendicular to the central (mean) ion path.

Since sector fields provide geometrical focusing, the ion beam crossovers 42 for ions of certain energy are created in the drift spaces between the sectors. For a typical acceptance of the MR TOF analyzer (i.e., phase space spread accepted by the analyzer) which is about 2 mm width and about 0.4 degree angular spread in the plane of deflection, the beam crossover position practically coincides with the point of focusing of initially parallel ion beam 41. At any crossover position 42 energy filtering of ions can be performed by placing a narrow slit aperture 43. For the just given phase space of the ion beam C-shaped interface with deflection radius of 50 mm provides the energy resolving power about 2%.

A two dimensional electrostatic lens 35 is placed in front of the interface for tuning the position of the crossover. This lens also helps to make the exiting ion beam 37 essentially parallel. Changing excitation of this lens does not violate the isochronous character of the interface in the first order.

The described C-shape interface is cylindrical, i.e., has two-dimensional geometry. The depth of the device (perpendicular to the drawing plane) is not limited by ion optics requirements and by the geometry of the planar MR TOF analyzer. The interface can accept ion bunches elongated in the orthogonal direction. It does not distort ion optics properties of the interface since the elongation is perpendicular to the plane of beam deflection. This makes the interface compatible with various elongated ion sources, like an orthogonal accelerator or a linear ion trap pulsed converter, which are described in text below.

Figure 4B:
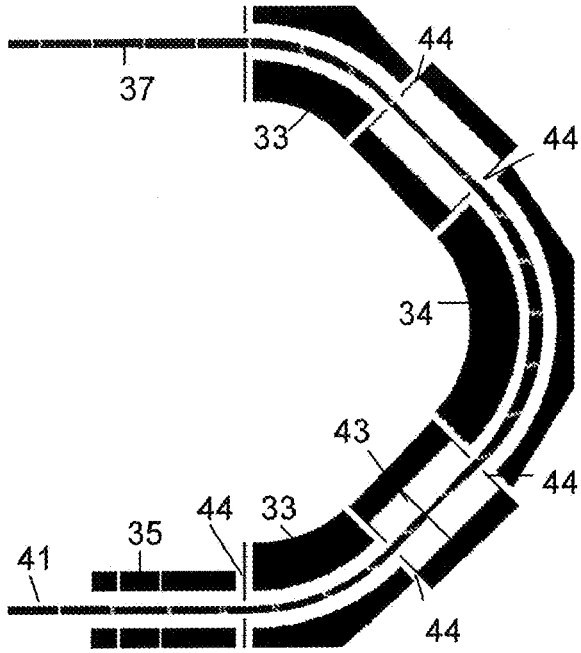
FIG. 4B shows geometrical details of the C-shaped sector interface.

FIG. 4B shows more details on geometrical configuration of the C-shaped interface. Ion entrance and exit of each sector are terminated by "fringing field shielding apertures" 44. Optionally, the top and the bottom side of the sectors are shielded by so called "Matsuda plates" (not shown). Drift potential is applied to shielding apertures, Matsuda plates and the shields surrounding drift spaces.

FIG. 4B also shows transformation of time fronts (white lines across the ion trajectories) for initially parallel ion beam. These fronts are perpendicular to ion path 41 at the entrance to the device and they are nearly orthogonal to ion path 37 behind the interface. More importantly, the fronts are parallel to the axis of symmetry of the planar MR TOF analyzer, also coinciding with the plane of the detector, which makes the overall system spatially isochronous.

It is anticipated that small deviations of the geometry from the ideal would cause ion front tilting. Minor adjustments of ion trajectories and of time front tilt could be made in the following way. By applying an additional weak voltage to one of electrodes of the last 45-degree deflector or by changing its bending angle, the total angle of deflection can be slightly changed, for example, to 179 degrees, as shown in FIG. 3A. The tilt of the time fronts occurring in this case can be compensated, for example, by slightly changing potential of Matsuda plates or alternatively by applying toroidal sector deflectors instead of cylindrical ones.

Figure 4C:
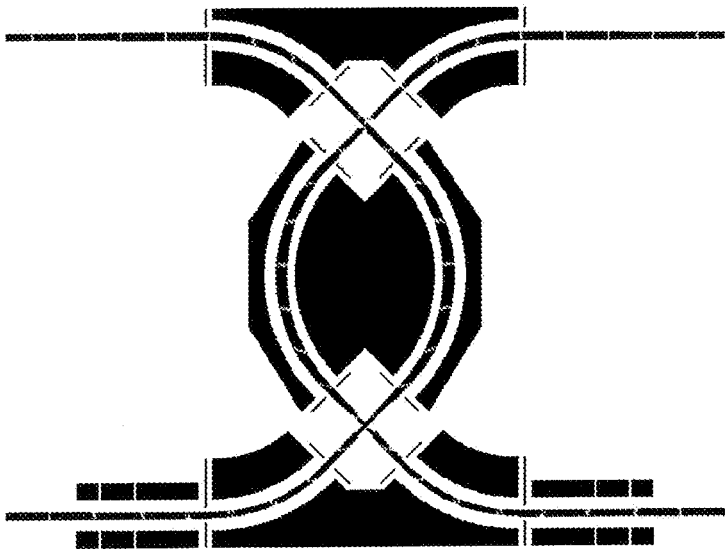
FIG. 4C shows a particular embodiment with two C-shaped interfaces arranged in a cross configuration.

Referring to FIG. 4C, more than one interface could be employed, for example, one for ion injection into planar MR TOF analyzer and another one for ion ejection out of the analyzer. In one particular embodiment the two C-shaped interfaces are arranged "back to back" as shown in FIG. 3A or alternatively with crossed ion trajectories as shown in FIG. 4C.

Figure 5A:
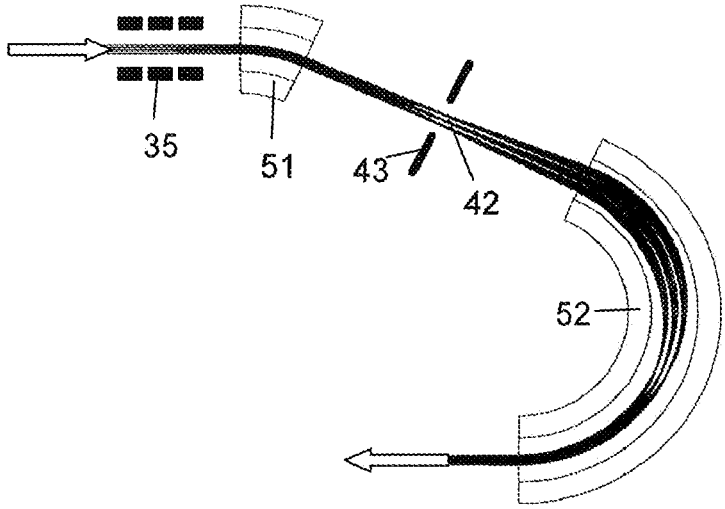
FIG. 5A shows a particular embodiment of isochronous curved ion interface built of two different cylindrical sectors and providing 180 degree total ion deflection.
Figure 5B:
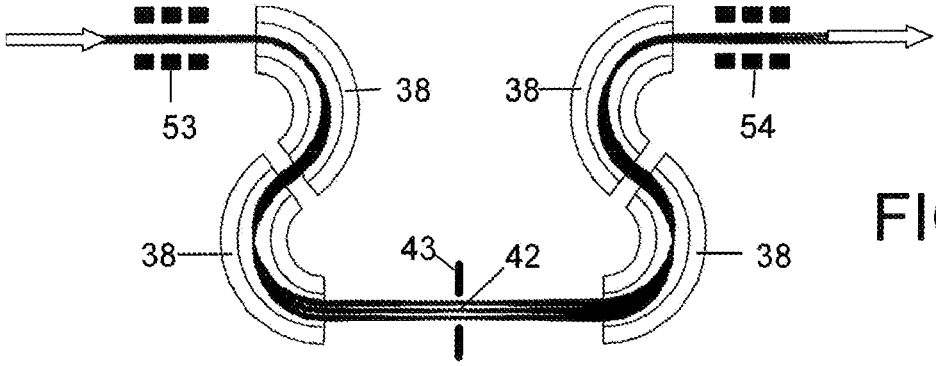
FIG. 5B shows a particular embodiment of omega-shaped isochronous interface with two symmetric parts being spatially separated.
Figure 5C:
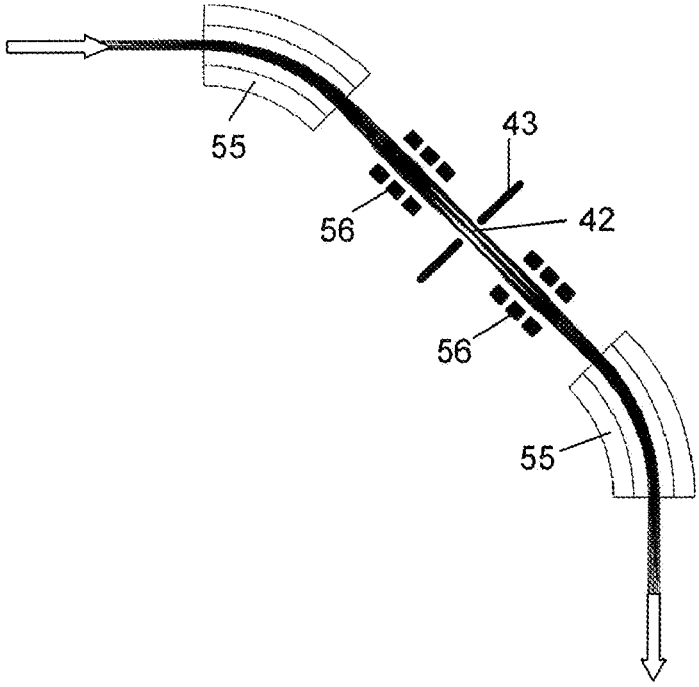
FIG. 5C shows a particular embodiment of an isochronous curved ion interface built of two identical cylindrical sectors and two lenses; the interface provides 90 degree total ion deflection.

FIGS. 5A-5C present several other types of curved isochronous interfaces built of electrostatic sectors.

FIG. 5A shows a particular embodiment of a 180-degree deflecting interface based on two cylindrical sector fields. To achieve spatial achromaticity (which automatically leads to spatial isochronous property) one cylindrical sector (51) has the deflection angle 24 degrees and the second one (52) has the deflection angle 156 degrees. Similar to the interface shown in FIGS. 4A-4C, the spatial crossover 42 of monochromatic ion beams is located between the sectors. A lens 35 may be used to adjust crossover position at the location of the optional energy filtering slit 43. Because of the small deflection angle of the sector 51, the energy resolution of the interface of FIG. 5A is about two times smaller than the resolution of the interface of FIGS. 4A-4C.

FIG. 5B shows a particular embodiment of the isochronous interface built of four sectors which are arranged in an Omega (Ω) shape. In one particular case, the interface comprises four identical 135-degree sectors 38 which are cylindrical but a slight toroidal field is arranged by employing Matsuda plates. In other cases, the angle may slightly vary so as the toroidal factor of nearly cylindrical sectors. Most important, the system should retain symmetry and to have zero angular dispersion in the middle. The output ion beam axis coincides with the input axis. A lens 53 in front of the first sector is employed to adjust the crossover plane 42 of the initially parallel ion beam. For best ion transmission and best energy filtering, the crossover plane should match the position of energy slit 43 in the middle of interface. The outgoing ion beam is made essentially parallel with the aid of a lens 54.

FIG. 5C shows the design of yet another isochronous interface with 90-degree deflection. The interface also has a symmetric geometry and comprises two 45-degree cylindrical or toroidal sectors 55 and two lenses 56 located between these sectors. The lenses are tuned such that the angular energy dispersion vanishes in the middle between two sectors. The distance between the sectors is chosen such that a monochromatic ion beam crossover position 42 is at the middle between the sectors and coincides with the position of an energy filtering slit 43.

The above described interfaces demonstrate an ability of adjusting the overall deflection angle. The Omega-shaped interface of FIG. 5B preserves the initial ion direction. The C-shaped interface of FIGS. 4A-4C and the interface of FIG. 5A displace the beam axis and also deflect the beam by 180 degrees. The interface of FIG. 5C provides a 90 degree overall turn. Other deflection angles of interfaces are possible while preserving isochronous properties. The exact deflecting angle can be fine adjusted as been described on the example of the C-shaped interface. Overall, a variety of solutions allows flexible geometrical design of the overall MR TOF MS and of other hybrid systems.

The examples of the considered interfaces illustrate a number of generic advantages of isochronous curved interfaces being applied in an MR TOF MS:

- The interfaces are capable of transferring ion packets with minimal spatial distortions. They convert a parallel beam into an essentially parallel beam with about the same size. The beam can be refocused several times within the interface, which helps ion beam confinement.
- Acceptance of the interface is not less than that of the MR TOF analyzer, i.e., the interface does not limit acceptance of the overall instrument.
- The interface may be used for minor adjustments of ion beam focusing, ion beam steering and for tilting time fronts as will be described below.
- The interface serves as an ideal restrictor for differential pumping. The long channel restricts the gas flow proportionally to a number of calibers. For example, sectors with a 1 cm wide gap and 20 cm ion path would limit the gas flow similarly to a 50 μm slit.

The interfaces are usually capable of energy filtering.

Figure 6A:
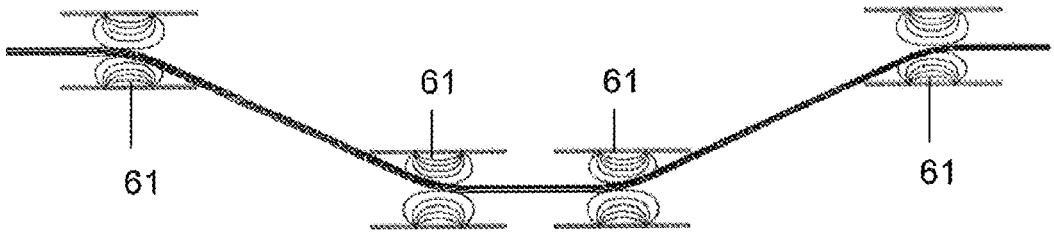
FIG. 6A shows a schematic for isochronous interfaces built of 4 plate deflectors arranged symmetric.

Referring to FIG. 6A, an isochronous interface with a curved axis for ion beam injection into the MR TOF analyzer can be designed using planar deflectors instead of sector ones, preferably using four symmetrically arranged planar deflectors 61. Each deflector comprises a pair of parallel planar electrodes which create a deflecting field and two pairs of shielding electrodes at both sides of the deflecting electrodes. FIG. 6A also shows equipotential lines of deflecting fields. The deflecting scheme is somewhat similar to the one in the omega-shaped interface of FIG. 5B. On one hand, the plate system looks mechanically simpler. On the other hand, its ion optics properties are inferior. Geometrical dimensions of planar deflectors prevent deflection to angles larger than about 20 degrees. For this reason the spatial dispersion created inside the deflector arrangement may be too low to provide for an efficient energy filtering. Also, the beam displacement is limited, second order aberrations are higher and the scheme is less preferred compared to sector analyzers.

Figure 6B:
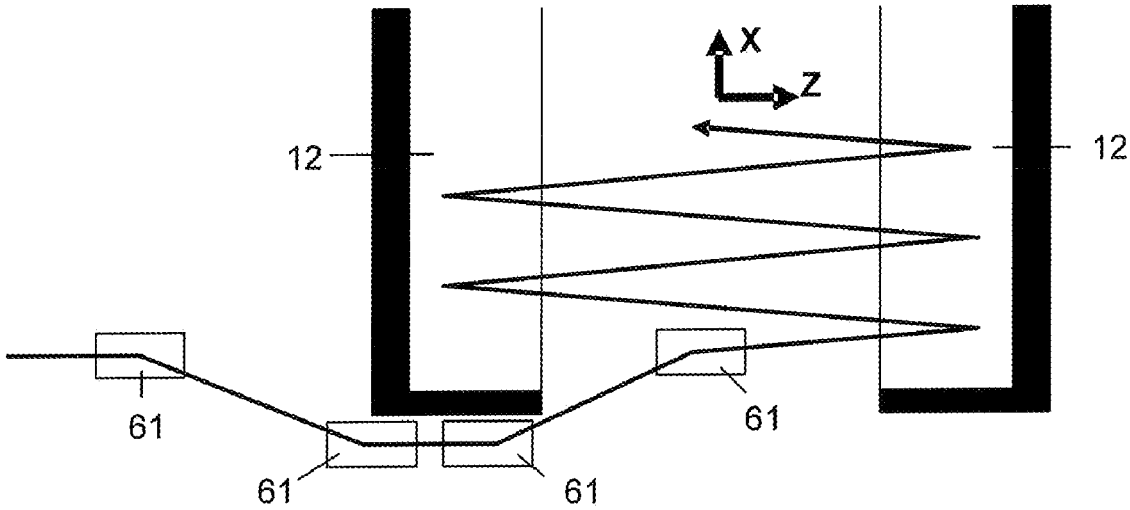
FIG. 6B shows schematics of ion passage around the short side of planar ion mirror.
Figure 6C:
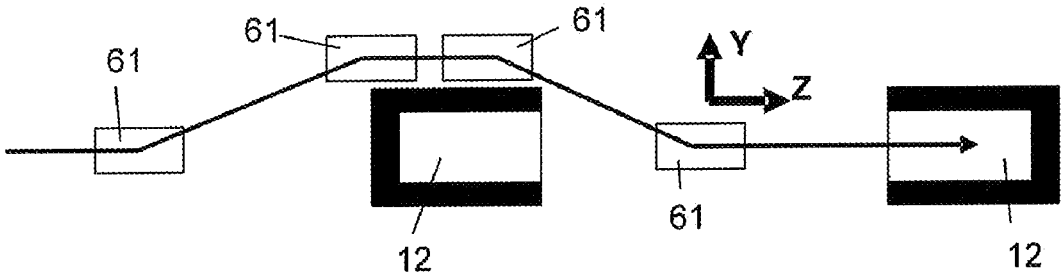
FIG. 6C shows schematics of ion passage around the long side of planar ion mirror with an optional pulsed operation of deflector.

Referring to FIG. 6B and FIG. 6C, the ion beam injection via plate interface can be made in two ways. In one way, the deflection plane of the interface coincides with the XZ plane of the jig-saw ion motion inside the MR TOF analyzer (FIG. 6B). Another way, the plane of deflection XY of the interface is perpendicular to the XZ plane (FIG. 6C). The latter requires a smaller displacement of the ion beam, but introduces an additional concern related to the width of deflector itself. This is a good example of where a pulsed operation of the interface helps. Ions are injected at one steady voltage and then the last deflector inside the analyzer is switched off for ion separation in the MR-TOF analyzer.

Figure 7A:
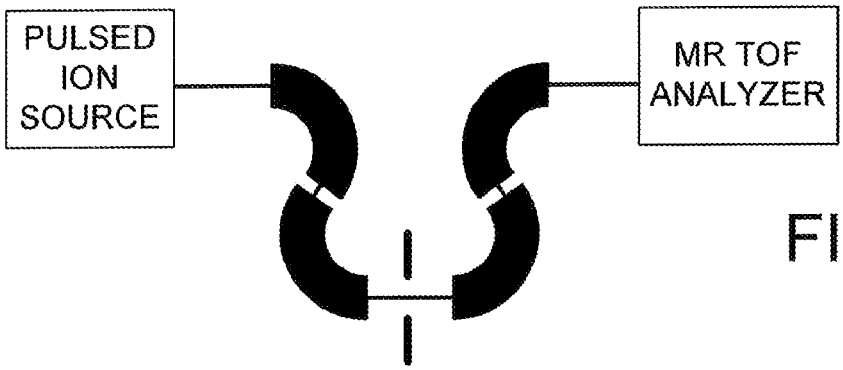
FIG. 7A shows an embodiment of an omega-shaped isochronous energy filter arranged externally to planar MR TOF analyzer.
Figure 7B:
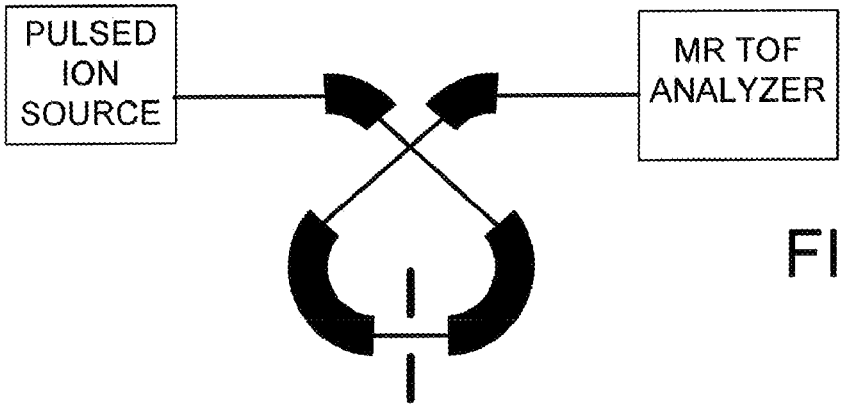
FIG. 7B shows an embodiment of an alpha-shaped isochronous energy filter arranged externally to planar MR TOF analyzer.

Referring to FIGS. 7A and 7B, the isochronous interface with a curved ion beam axis is not necessarily used for ions passing around edges of ion mirrors. It could be employed solely to filter ion energy spread which is created by a pulsed ion source. As will be discussed later, such filtering allows decreasing turn-around time in the ion source without deterioration of the MR TOF resolution. Multiple interface geometries, like those shown in FIGS. 4A-4C and 5A-5C, are suitable for energy filtering. FIGS. 7A and 7B present two types of isochronous and filtering interfaces which are also designed to preserve the initial direction of the ion beam. An omega-shaped filter is shown in FIG. 7A or an alpha-shaped filter is shown in FIG. 7B.

Again referring to FIGS. 7A and 7B, the deliberately introduced energy filtering properties of the interface are used to improve the characteristics of the ion packets, particularly for ion sources with compromised time and energy spreads.

In one group of ion sources (not shown), the naturally occurring energy spread may become excessive at unfavorable conditions. For example, pulsed ion extraction out of an electron ionization (EI) source may introduce excessive energy spread when using a wider electron beam. In matrix-assisted laser desorption ion (MALDI) sources, the ion energy deficit depends on ion-to-matrix collisions, which, in turn, strongly depends on small variations of laser energy as well as on matrix crystallization. Laser ionization sources are characterized by plasma formation and by excessive energy spread. The excessive energy spread should be filtered out to allow high resolution measurements in the MR TOF MS.

In another group of ion sources, the natural energy spread is moderate. However, a higher strength of accelerating field could be applied to improve a so-called turn around time, while a related increase in energy spread would be filtered in the interface. Such improvement is desirable for ion pulsed converters like an orthogonal accelerator (OA) and especially ion traps with axial and radial pulsed ion extraction. The converters may be employed for a wide range of continuous or quasi-continuous ion sources, comprising electrospray (ESI), atmospheric pressure chemical ionization (APCI), atmospheric pressure photo ionization (APPI), electron impact (EI), chemical ionization (CI), inductively coupled plasma (ICP), and matrix-assisted laser desorption ionization (MALDI) with collisional dampening. The converter also allows forming ion pulses after any fragmentation cell, particularly gas-filled fragmentation cells of tandem mass spectrometers.

Figure 8A:
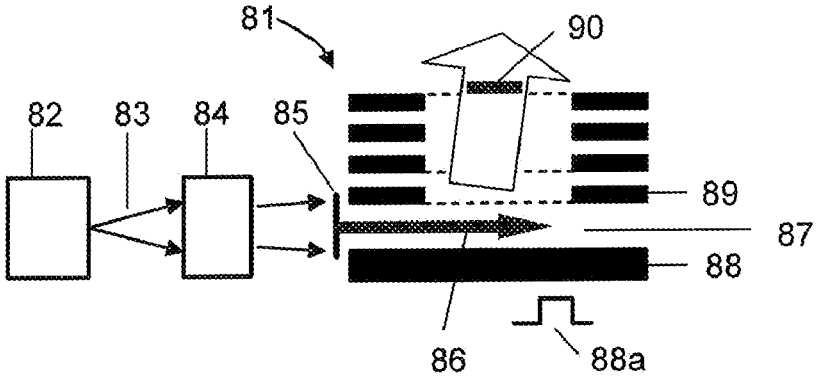
FIG. 8A presents a schematic side view of a pulse converter with an orthogonal accelerator.
Figure 8B:
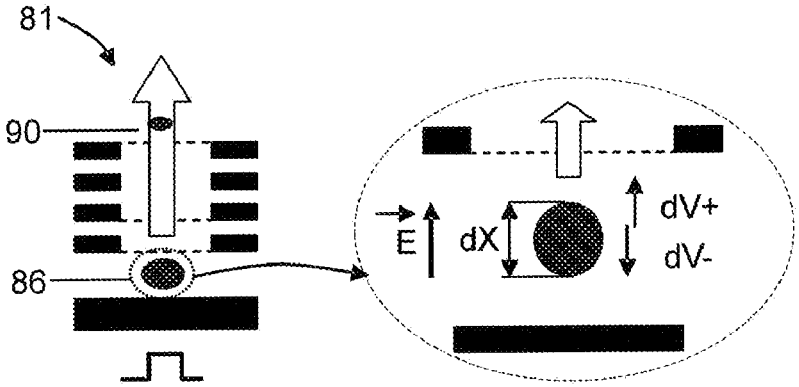
FIG. 8B presents a schematic view of the OA converter shown from another side. The figure also shows an expansion of the intraelectrode gap and details of ion beam parameters.

Referring to FIGS. 8A and 8B, two schematic side views are shown for an orthogonal accelerator 81. A continuous or quasi-continuous ion beam comes from a source 82. Preferably, the orthogonal accelerator operates with cold ion beams. Such ion beams are prepared after collisional cooling in the ion guide of the source 82. The beam 83 is then expanded within an ion optic system 84 to reduce ion beam divergence. After cutting a noticeable portion (usually ⅔) of the beam at a slit 85, the phase space of the ion beam is reduced to about 1 deg×1 mm at 10-30 eV ion energy. An almost parallel ion beam 86 is introduced at moderate energy into a field free gap 87, formed between a push plate 88 and an electrode 89 with a window for ion extraction. Periodically, slowly passing ions 86 are ejected in the orthogonal direction by at least one pulse 88*a* applied to the push plate. Ion packets 90 are ejected out of DC stage of acceleration, while remaining parallel to the direction of the initial ion beam 86.

Referring to FIG. 8B, in spite of ion beam cooling (which is arranged by ion beam expansion and by skimming the beam on a slit), still TOF resolution is limited by initial parameters of the ion beam—velocity $\Delta V$ and spatial $\Delta X$ spread across the accelerator gap 87. Turn-around time $\Delta T$ and energy spread $\Delta k$ of ion packets 90 after acceleration are defined as: $\Delta T=\Delta Vm/Ee$ and $\Delta k=\Delta xE$, where E is the strength of accelerating field. Usually the ion energy spread is adjusted below the energy tolerance of TOF MS, which poses a limit onto the strength of accelerating field. When using an energy filter of the present invention, the excessive energy spread is no longer a concern and one may improve the turn-around time by applying a stronger accelerating field E.

FIG. 9 presents an example of another pulsed converter, a linear ion trap with axial ion ejection 91, described in [Kozlov et. al. ASMS 2005 (www.asms.org)]. The trap is arranged within a gas-filled ion guide 93. A radial ion confinement is arranged by forming a radio frequency (RF) field within a main section of the guide 93 and within a small exit section 95. An axial DC well is arranged to trap ions near the exit of the ion guide. The DC profile shown in graph 97 is formed by applying a retarding potential to exit aperture 96 as well as applying an attractive DC potential to a small segment 95 of the ion guide.

Ions are injected along the ion guide axis. The guide operates at a gas pressure of 1 to 3 mTorr which ensures ion dampening and trapping of ions in the DC well within 1 to 3 ms time. The injection and trapping occur at nearly 100% efficiency. After complete ion dampening the beam size becomes below 1 mm. A pulsed field is applied to extract ions. To form a uniform extracting field, a push pulse is applied to a push ring 94 and a smaller Pull pulse is applied to the exit aperture 96. Alternatively, both trapping and extraction field are formed using auxiliary electrodes with electric fields penetrating between rods.

As in any type of ion trap the ion cloud is at least room temperature or hotter. As a result the velocity spread is about 3 times larger compared to OA. Ion trap sources are not widely employed as pulsed converters for a TOF MS, primarily because of large phase space of ion packets. Again, the situation can be improved by using the isochronous energy filtering of the invention. A stronger field could reduce the turn-around time, while excessive energy would be filtered out by the curved interface.

Energy filtering also allows shorter accumulation times (when ion dampening is not complete) and using larger gas pressures in ion trap converters (which causes ion scattering at pulsed extraction and a 'halo' of low energy ions). Both measures allow improving the repetition rate and the dynamic range of the instrument. Energy filtering also makes the instrument less dependent on ion source variations, i.e., provides decoupling between the ion source and the analyzer properties.

FIGS. 10A-10D present yet another example of an ion pulse converter—a rectilinear ion trap 101 with radial ion injection. A confining radio frequency field is formed by applying an RF signal between parallel plates 103, 104 and 105 which form a quadrupolar field near the axis. In one particular embodiment, an asymmetric RF field can be applied, for example, only to side plates 104. A long DC well is formed by applying retarding DC potentials (in addition to the RF signal) to terminating segments 102 of the ion trap, with the same RF signal but with a different DC offset. The trap is filled at approximately 1 to 3 mTorr gas pressure. Ions are injected along the axis and eventually (in 1-3 ms) get confined within a long DC well. Similarly, pulse voltages are applied to top 105 and bottom 103 plates to eject ions through the slit in the top plate.

According to the third aspect of the invention, a delayed extraction out of a trap is combined with energy filtering in the spatially isochronous interface and with subsequent mass analysis in any TOF analyzer. Any type of ion trap converter is usable, including the above-described examples of linear ion traps with radial and axial ion ejection. Ion packets expand before ejection. The non-correlated turn around time becomes lower while excessive energy spread is rejected in the energy filter.

Again referring to FIGS. 10A-10D, the rectilinear trap is particularly well suited for implementing the third aspect of the invention, i. e., for a delayed ion extraction from the trap followed by energy filtering. A diagram of voltage dynamics is shown in FIGS. 10B-D. The RF signal is applied to side plates 104 at ion injection and dampening (FIG. 10B). Then the RF signal is switched off or rapidly ramped down (FIG. 10C), for example, by moving the RF circuit far from resonance. After a predetermined delay pulse, the pulse voltages are applied to top 105 and bottom 103 plates to form a nearly homogeneous extracting field (FIG. 10D). Ions get ejected into a grid-free DC acceleration stage, which is preferably terminated by a two-dimensional lens 106. Then excessive energy is filtered out in any isochronous energy filter 107 and the transferred ion packets are mass separated in a TOF analyzer 108. In one particular embodiment, a sector analyzer itself could be employed as a time-of-flight analyzer. However, preferably, such a TOF analyzer should employ a grid-free ion mirror 109 to compensate for second order spatial and energy aberrations of the energy filter.

Figure 11:
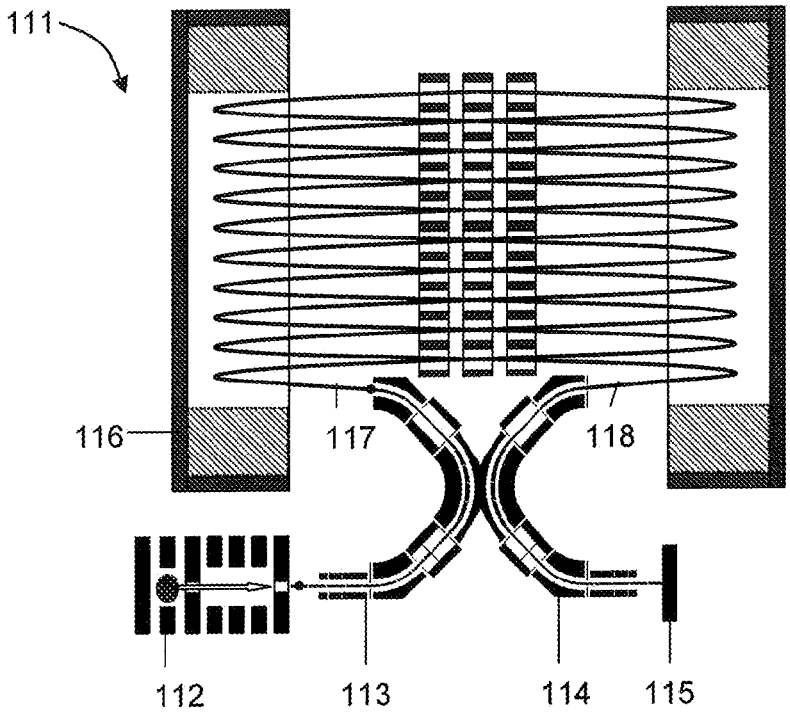
FIG. 11 presents a schematic of the preferred embodiment of the invention, comprising an ion trap with a delayed extraction, an isochronous C-shaped energy filter and a MR TOF analyzer with periodic lenses. The figure also illustrates the third aspect of the invention.

Referring to FIG. 11, a preferred embodiment 111 of the third aspect of the invention comprises a rectilinear ion trap 112 with delayed extraction, a C-shaped cylindrical interface 113 and a planar MR TOF analyzer 116. It also may comprise an optional second isochronous interface 114 and an external ion detector (receiver) 115. The long side of linear trap 112 is oriented across the plane of jig-saw ion trajectory in the MR TOF MS (here perpendicular to the drawing plane). An extracting pulse is applied after some predetermined delay (in microsecond time scale) after switching off the RF signal on the trap. Non-correlated velocity spread is reduced. An excessive energy is filtered out in the energy analyzer. Ion packets are ejected along a slightly tilted trajectory 117 to be aligned with the drift angle of the planar MR TOF analyzer with periodic lenses. In the particular embodiment, the ions are reflected in the last lens. This reverses the drift motion and doubles the flight path of the analyzer. After time separation in the MR TOF analyzer, ions come along the trajectory 118, get isochronously transferred via interface 114 and hit the TOF detector 115.

According to the fourth aspect of the invention, at least one spatially isochronous interface with a curved ion path is employed to transfer ions between portions of a planar multi-reflecting time-of-flight analyzer. A number of such hybrid analyzers could be composed of electrostatic sectors and of grid-free ion mirrors without compromising high order time-of-flight focusing.

Note that the ion mirror does not have to be planar and does not necessarily comprise ion lenses.

Figure 12A:
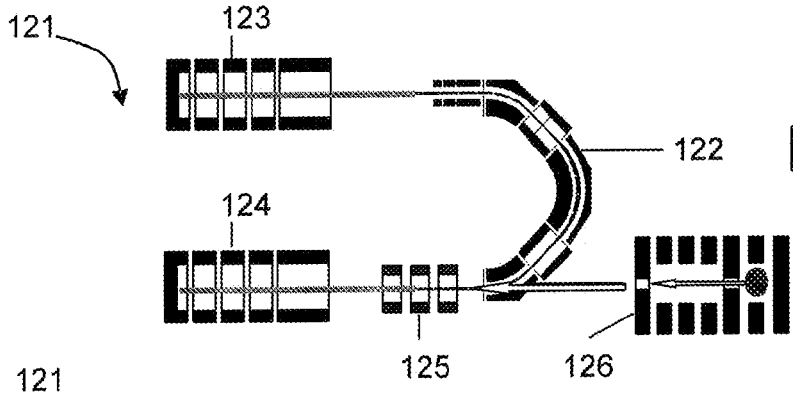
FIGS. 12A and 12B illustrate the fourth aspect of the invention. They also present a particular embodiment of two planar ion mirrors interconnected by a curved cylindrical sector interface.
Figure 12B:
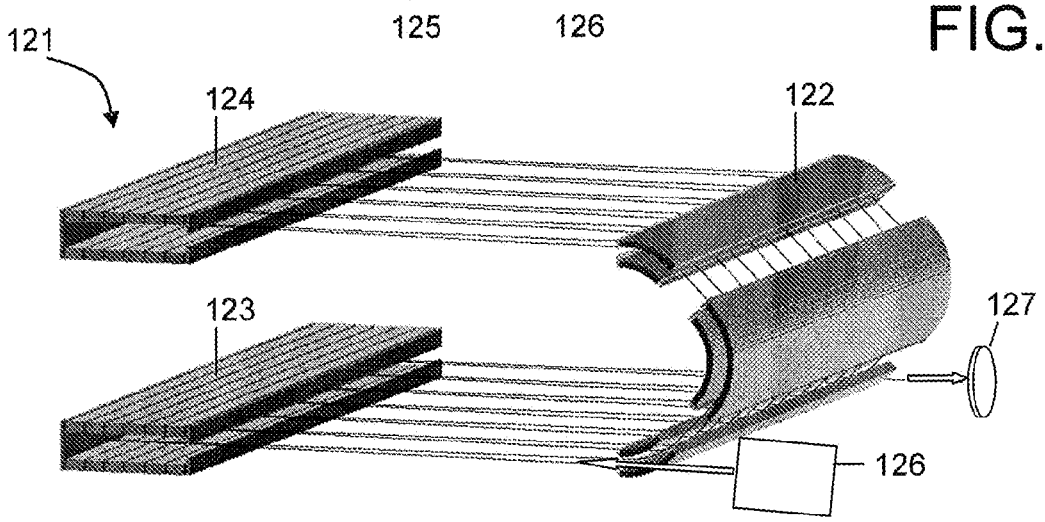

Referring to FIG. 12A, in one particular embodiment 121, an isochronous cylindrical interface 122 with 180 degree deflection is suggested to transfer ions between two parallel ion mirrors—one mirror 123 sitting on the top of another 124. The arrangement opens ion access in and out of the planar ion mirror far from fringing fields in the mirror. An exemplar ion source 126 is shown opposite of the lower mirror 124.

FIG. 12B shows a three-dimensional view of the same embodiment 121, also showing an ion detector 127 at the back side of the MR TOF analyzer.

Figure 13:
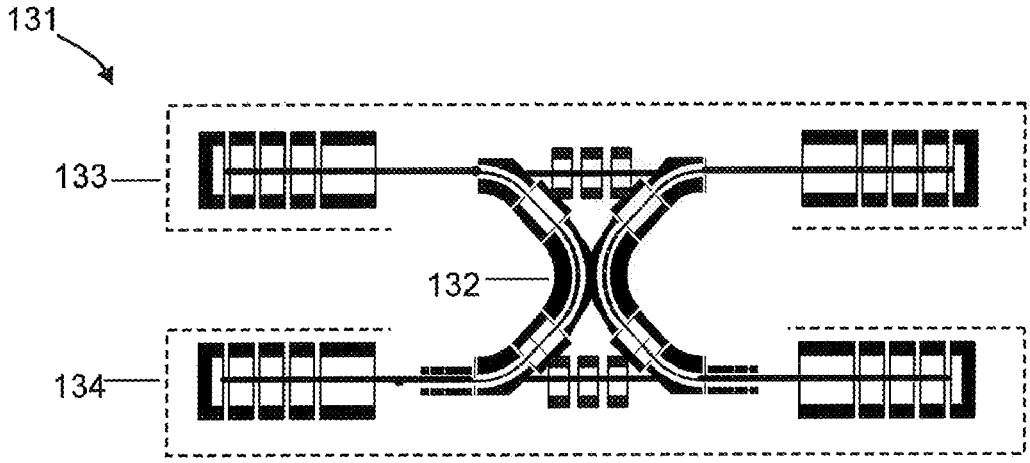
FIG. 13 presents a schematic view of two planar MR TOF analyzers interconnected by curved isochronous interfaces.

Referring to FIG. 13, in another particular embodiment 131, a curved and spatially isochronous interface 132 is employed to transfer ions between at least two parallel MR TOF analyzers 133 and 134, aligned into a multi-level assembly. Isochronous curved interfaces are used to pass ions between the floors.

Both above embodiments maximize the ion path per vacuum chamber size. Multiple parallel mirrors could be conveniently and inexpensively made by machining multiple windows within the same electrodes.

An isochronous interface can be also employed to reverse the direction of ion drift motion (not shown). It could be used to transfer ions between different analyzers while being pulsed and static operated (not shown) or between multiple stages of tandem mass spectrometric analysis (described below). The curved sector is preferably made cylindrical for simpler manufacturing and alignment.

It is of significance that systems based on electrostatic sectors are usually energy isochronous only in the first approximation. Most of them are spatially isochronous also only in a linear approximation. The invention stresses the fact that, for any spatially isochronous sector, the second order time aberrations can be compensated within planar and grid-free ion mirrors. The design of hybrid systems can be even more flexible when considering the ability of ion mirrors to compensate for the first order time deviations with respect to energy, which loosen limitations on sector field design. In other words, sector fields are not expected to compromise parameters of the hybrid system. Overall performance including time-of-flight resolution, energy acceptance and spatial acceptance of the hybrid TOF can be comparable to a planar MR TOF MS. At the same time curved sectors provide flexibility in the system design as well as earlier stressed advantages of the easier ion introduction and the ability of energy filtering. When using cylindrical sectors, the hybrid system appears to have a comparable mechanical complexity to an MR TOF analyzer.

Similarly, grid-free ion mirrors may compensate for second order chromatic spatial aberrations of the sector devices.

In addition, curved and isochronous interfaces may be used in multiple ways within tandem instruments which are based on a planar MR TOF analyzer.

Figure 14:
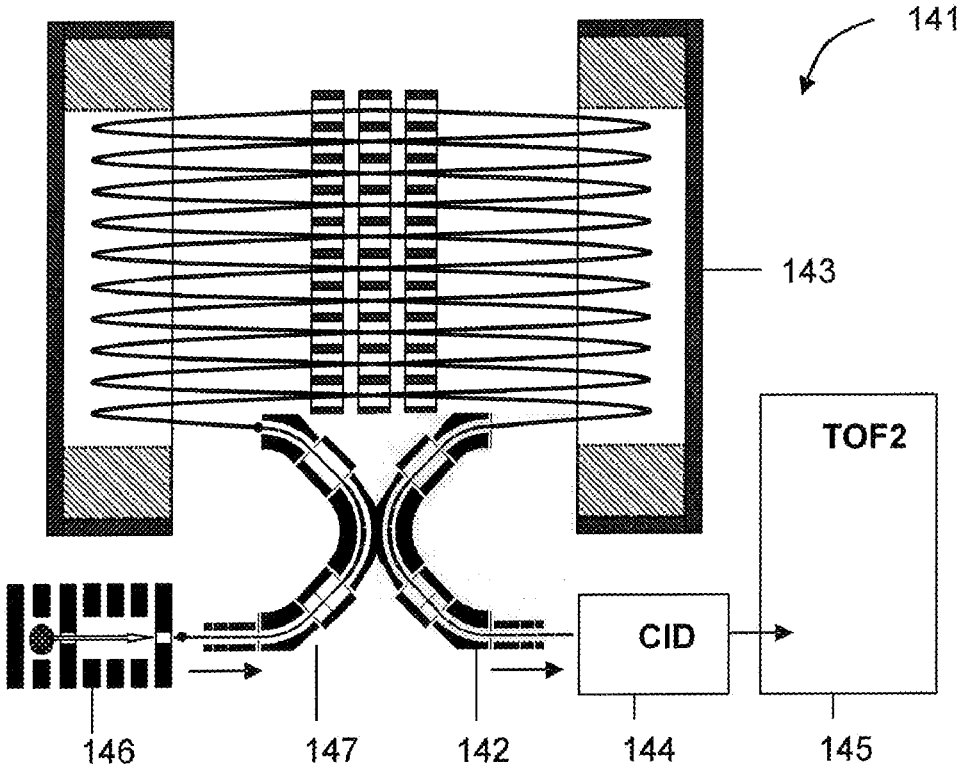
FIG. 14 presents a schematic of tandem TOF-TOF instrument with curved interface employed for ion injection in and out of the planar MR TOF separator of parent ions.

Referring to FIG. 14, in one particular embodiment, a tandem MS-MS 141 comprises a sequentially interconnected linear ion trap pulsed converter 146, an isochronous curved interface 147, an MR TOF MS analyzer 143, an exit isochronous ion interface 142, a CID fragmentation cell 144 and a second mass analyzer 145. Both curved interfaces are isochronous and do not disturb time-of-flight separation. The combination of the MR TOF and the interfaces provides for spatial focusing and helps ion transmission through an entrance aperture of the CID cell. Both interfaces also serve as restricting channels for limiting gas flow between analyzer 143 and the mid vacuum stages of ion source 146 and of CID cell 144. The exit interface 142 is also used to adjust energy of ions entering the CID cell and this way to adjust a degree of fragmentation. Preferably, second analyzer 145 is a time-of-flight analyzer.

Preferably, CID cell 144 is made short (several cm long), filled to a relatively high gas pressure (about 50 mTorr) and also has means for accelerating ion axial transfer. Such cells are proven to provide for rapid ion transfer within tens of microseconds. The first planar MR TOF 143 provides a prolonged time separation of parent ions in a millisecond time scale and the second—fast TOF2 analyzer 145—in the microsecond time scale. Such arrangement is disclosed in commonly assigned U.S. patent application Publication No. 2005/0242279 A1, filed on Jan. 11, 2005 by Anatoli Verentchikov, which arranges a so-called parallel TOF-TOF analysis using a regime of so-called nested time scales. The entire disclosure of this published application is incorporated herein by reference.

Figure 15:
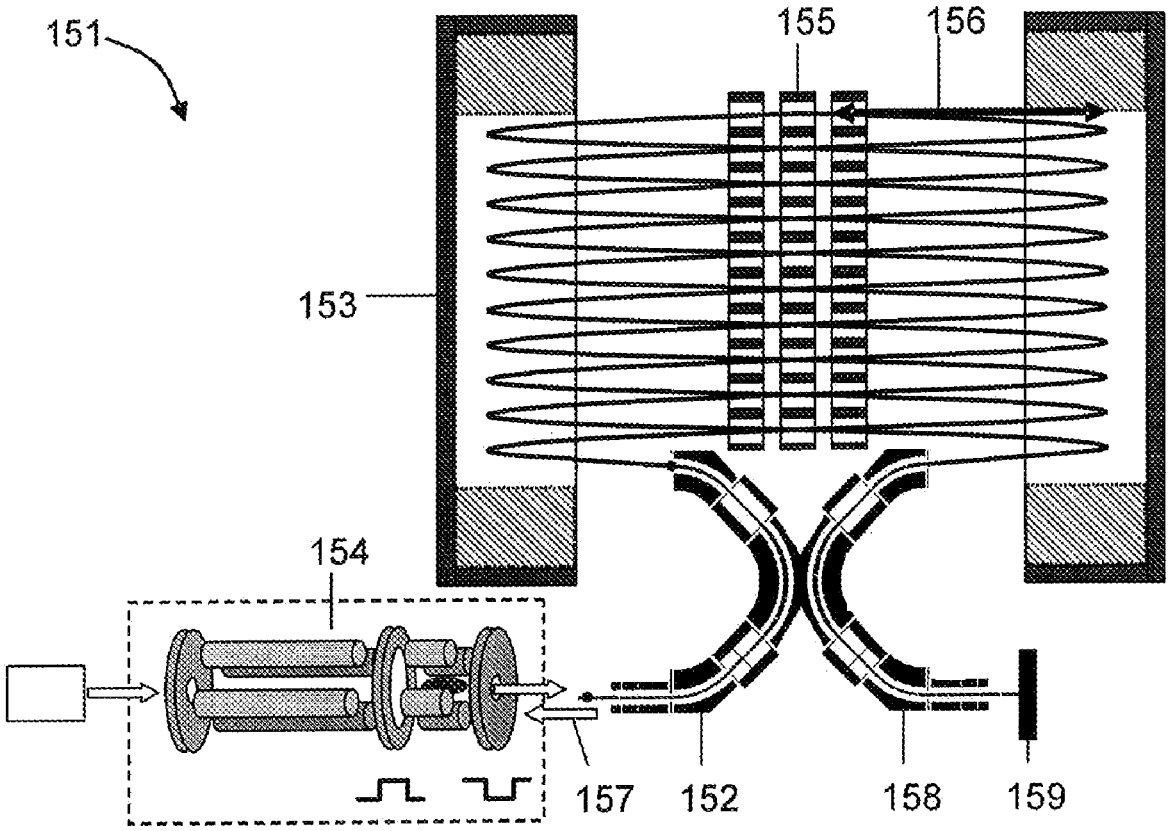
FIG. 15 presents a schematic of tandem TOF-TOF where pulsed trap converter is also employed as a fragmentation cell and a curved interface is employed for an ion isochronous transfer between ion trap/fragmentation cell and the planar MR TOF analyzer.

Referring to FIG. 15, in another particular embodiment of tandem MS-MS 151 of the invention, the ion trap source 154 also works as a fragmentation cell. The same MR TOF analyzer 153 is employed for both parent ion selection and mass analysis of fragment ions. The curved interface 152 between the trap and the MR TOF analyzer performs multiple functions. It improves the characteristics of the ion packets, improves ion transfer, improves time-of-flight separation, limits gas flows, and also adjusts ion energy at the fragmentation step.

In operation, the ion beam from the ion source is accumulated and dampened in the ion trap converter 154. Preferably the trap converter is a gas-filled linear ion trap with an axial ion ejection as described in FIG. 9. Pulses applied to auxiliary electrodes eject ions out of the trap. Ions get transferred through the curved interface 152 and then are mass separated in the planar multi-reflecting TOF MS 153. For the first cycle ion motion is fully reversed in the last lens 155 as shown by ion trajectories 156. Ion packets pass back through the analyzer, enter the interface 152 and then enter the cell 154 as shown by reversed arrow 157. An ion selector (not shown) is employed somewhere in the ion path to select a single mass to charge ratio ion species. Only those species are admitted back into the cell. The desired energy range is selected in the curved interface. Selected ions are decelerated and admitted into the ion trap 154, which now serves as a gas-filled fragmentation cell with collision induced dissociation (CID). If injection energy is sufficient, the injected ions form a set of information containing fragments. The fragment ions are dampened in the subsequent gas collisions and are prepared for the secondary injection into the same analyzer. This time the mass separated ions are directed onto an ion detector by using full angle deflection in the last deflector 155. Packets of fragment ions travel via exit interface 158 and hit detector 159.

The instrument provides tandem MS analysis within the same analyzer and the same trap/CID cell. The curved interface serves as a convenient means for an isochronous ion and efficient introduction in and out of the MR TOF analyzer. It also serves for improving the characteristics of the ion trap source, for limiting gas flux between stages and even more it also serves for correction of ion injection energy, thereby controlling the degree of ion fragmentation.

All aspects of the invention are applicable to multiple tandem instruments: tandems with various separation methods at the front end, like chromatography and electrophoresis—LC-TOF, CE-TOF. Other types of tandems are double mass spectrometry systems like Q-TOF and TOF-TOF.

The above description is considered that of the preferred embodiment only. Modifications of the invention will occur to those skilled in the art and to those who make or use the invention. Therefore, it is understood that the embodiment shown in the drawings and described above is merely for illustrative purposes and not intended to limit the scope of the invention, which is defined by the following claims as interpreted according to the principles of patent law, including the doctrine of equivalents.

What is claimed is:

1. A multi-reflecting time-of-flight mass spectrometer apparatus comprising:

a pulsed ion source for generating ion packets;

a planar multi-reflecting time-of-flight analyzer for separating ions of the ion packets by mass-to-charge ratio;

an ion receiver for receiving the separated ions; and at least one spatially isochronous ion transfer interface, located in-between said ion source and said ion receiver, wherein said at least one spatially isochronous ion transfer interface has a curved axis.

2. The apparatus of claim 1, wherein said multi-reflecting time-of-flight analyzer includes grid-free ion mirrors.

3. The apparatus of claim 1, wherein said multi-reflecting time-of-flight analyzer comprises a field-free region and at least two focusing lenses in the field-free region for periodic refocusing of an ion beam in a drift direction.

4. The apparatus of claim 1, wherein said at least one interface is achromatic.

5. The apparatus of claim 1, wherein said at least one interface has an isochronous plane aligned with at least one of: a symmetry plane of said multi-reflecting time-of-flight analyzer and a plane of said ion receiver.

6. The apparatus of claim 5, wherein the isochronous plane has an orientation that is adjustable within said at least one interface.

7. The apparatus of claim 1, wherein said at least one interface is energy isochronous.

8. The apparatus of claim 1, wherein said multi-reflecting time-of-flight analyzer compensates for at least one type of second order time-of-flight aberration originating in said interface.

9. The apparatus of claim 1, wherein said multi-reflecting time-of-flight analyzer compensates for at least one type of spatial aberration originating in said interface.

10. The apparatus of claim 1, wherein said at least one interface is imbedded into said multi-reflecting time-of-flight analyzer to pass ions by the edge and fringing fields of at least one ion mirror of said analyzer.

11. The apparatus of claim 1, wherein said at least one interface comprises at least one of: an electrostatic cylindrical sector, an electrostatic toroidal sector, and an electrostatic spherical sector.

12. The apparatus of claim 11, wherein said at least one interface comprises an electrostatic lens.

13. The apparatus of claim 11, wherein said at least one interface comprises Matsuda plates.

14. The apparatus of claim 1, wherein said at least one interface comprises at least one electrostatic planar deflector.

15. The apparatus of claim 1, wherein said at least one interface is arranged to substantially preserve an initial direction of the ion trajectory.

16. The apparatus of claim 1, wherein said at least one interface is arranged to turn the ion trajectory substantially orthogonal.

17. The apparatus of claim 1, wherein said at least one interface is arranged to substantially reverse a direction of the ion trajectory.

18. The apparatus of claim 1, wherein at least one voltage of said at least one interface is pulsed.

19. The apparatus of claim 1, wherein said at least one interface comprises means for controllable energy filtering of ions.

20. The apparatus of claim 19, wherein said means for controllable energy filtering of ions comprises a slit.

21. The apparatus of claim 20, wherein said slit is adjustable.

22. The apparatus of claim 20, wherein said means for controllable energy filtering of ions further comprises a spatially focusing lens for adjusting a crossover plane of ion trajectories at said slit.

23. The apparatus of claim 19, wherein said pulsed ion source employs an extracting electric field having a strength that is adjusted to form the ion packets with an energy spread exceeding an admitted energy spread of said at least one interface.

24. The apparatus of claim 1, wherein said planar multi-reflecting time-of-flight analyzer comprises a field-free region and at least one deflector in the field-free region to reverse ion drift motion.

25. The apparatus of claim 1, wherein said ion receiver comprises one of: a time-of-flight ion detector; a surface for ion deposition; a fragmentation cell of a tandem mass spectrometer; an ion trap for fragmenting ions and their release back into said multi-reflecting time-of-flight analyzer; and a fast transfer fragmentation cell for parallel MS-MS analysis in the regime of time-nested data acquisition.

26. The apparatus of claim 1, wherein said at least one interface is arranged to transfer the ion packets between portions of said multi-reflecting time-of-flight analyzer.

27. The apparatus of claim 1, wherein said at least one interface is arranged to transfer the ion packets between at least two multi-reflecting time-of-flight analyzers.

28. The apparatus of claim 1, wherein said pulsed ion source comprises intrinsically pulsed ion sources selected from the group consisting of: a MALDI ion source, a MALDI with delayed ion extraction, a pulsed electron impact ion source, a SIMS pulsed ion source, and a laser desorption ion source.

29. The apparatus of claim 1, wherein said pulsed ion source comprises a pulse converter and one continuous or quasi-continuous ion source selected from the group consisting of: an ESI, an APCI, an APPI, a CI, an EI, an ICP, and a fragmenting cell of a tandem mass spectrometer.

30. The apparatus of claim 29, wherein said pulse converter is selected from the group consisting of: a Paul three-dimensional ion trap, a gas-filled linear ion trap with axial ejection, a gas-filled linear ion trap with radial ejection, an orthogonal accelerator and an ion trap followed by an orthogonal accelerator.

31. A time-of-flight mass spectrometer apparatus comprising:

a gas-filled ion trap for generating ion packets, said ion trap including at least one electrode to which a radio frequency signal is applied, wherein the ion packets are extracted from said ion trap after a predetermined delay after switching of said radio frequency signal;

a time-of-flight mass analyzer for separating ions according to their mass-to-charge ratio;

an ion receiver for receiving the separated ions; and a spatially isochronous energy filter positioned between said ion trap and said ion receiver for transferring ions within a limited energy range.

32. The apparatus of claim 31 and further comprising an ionizer for generating and feeding ions into said ion trap.

33. The apparatus of claim 31, wherein said time-of-flight mass analyzer comprises ion mirrors which compensate for at least second order time-of-flight aberration with respect to ion energy.

34. The apparatus of claim 31, wherein said time-of-flight mass analyzer comprises ion mirrors that are grid-free and are adjustable to compensate for at least one type of aberration occurring in said energy filter and related to ion coordinates; said aberrations including at least one of those in the group consisting of: time-of-flight aberration with respect to spatial coordinates, spatial aberrations, and chromatic aberrations.

35. A hybrid time-of-flight mass analyzer apparatus comprising:

at least one spatially isochronous set of electrostatic sectors;

at least one ion mirror; and an ion receiver, wherein said ion mirror compensates for at least one second order time-of-flight aberration of the set of electrostatic sectors.

36. The apparatus of claim 35, wherein said at least one ion mirror is a grid-free ion mirror.

37. The apparatus of claim 36, wherein said at least one ion mirror compensates for at least one second order aberration of said set of electrostatic sectors and related to spatial coordinates of ions; said group of aberrations consists of: time-of-flight aberration with respect to spatial coordinates, spatial aberrations, and chromatic aberrations.

38. The apparatus of claim 35, wherein said ion receiver is position-sensitive for imaging time-of-flight mass spectrometry.

39. An apparatus comprising:

an ion source for generating ions;

a linear ion trap with a delayed ion extraction for ion accumulation and formation of ion packets;

a planar multi-reflecting time-of-flight analyzer having a drift space with periodic lenses;

an ion receiver; and at least one spatially isochronous C-shaped cylindrical interface located in between said linear ion trap and said ion receiver.

40. A multi-reflecting time-of-flight mass spectrometer apparatus comprising:

a pulsed ion source for generating ion packets;

a multi-reflecting time-of-flight analyzer for separating ions of the ion packets by mass-to-charge ratio;

an ion receiver for receiving the separated ions; and at least one spatially isochronous ion transfer interface, located in-between said ion source and said ion receiver, wherein said at least one spatially isochronous ion transfer interface includes at least one electrostatic sector having a curved axis.

41. The apparatus of claim 40, wherein said at least one electrostatic sector comprises at least one of: an electrostatic cylindrical sector, an electrostatic toroidal sector, and an electrostatic spherical sector.

42. The apparatus of claim 40, wherein said multi-reflecting time-of-flight analyzer is a planar multi-reflecting time-of-flight analyzer.

* * * * *

UNITED STATES PATENT AND TRADEMARK OFFICE

CERTIFICATE OF CORRECTION

PATENT NO. : 7,326,925 B2
APPLICATION NO. : 11/277181
DATED : February 5, 2008
INVENTOR(S) : Anatoli Verentchikov et al.

It is certified that error appears in the above-identified patent and that said Letters Patent is hereby corrected as shown below:

Column 2, line 31, "$x/\alpha$, $\alpha$," should be --$x/\alpha\alpha$,--.

Column 3, line 10, "$T/\beta 0$)" should be --$T/\beta=0$)--.

Signed and Sealed this

Fifth Day of August, 2008

JON W. DUDAS
*Director of the United States Patent and Trademark Office*